US008001823B2

(12) United States Patent
Straka et al.

(10) Patent No.: US 8,001,823 B2
(45) Date of Patent: Aug. 23, 2011

(54) MULTI-DRIVE TOOLING

(75) Inventors: Gordon A. Straka, Afton, MN (US); Jon M. Shimota, Stillwater, MN (US); Brian J. Lee, Elk River, MN (US)

(73) Assignee: Wilson Tool International Inc., White Bear Lake, MN (US)

( * ) Notice: Subject to any disclaimer, the term of this patent is extended or adjusted under 35 U.S.C. 154(b) by 569 days.

(21) Appl. No.: 11/778,922

(22) Filed: Jul. 17, 2007

(65) Prior Publication Data

US 2009/0019977 A1 Jan. 22, 2009

(51) Int. Cl.
*B21J 13/00* (2006.01)
*B26D 5/08* (2006.01)

(52) U.S. Cl. ..... 72/441; 72/405.03; 72/446; 83/549; 83/552

(58) Field of Classification Search ..... 72/405.03, 72/431, 441, 442, 444, 446, 465.1, 296, 482.93; 83/129, 136, 140, 549, 552
See application file for complete search history.

(56) References Cited

U.S. PATENT DOCUMENTS

| | | | | |
|---|---|---|---|---|
| 1,157,213 | A | 10/1915 | Forsyth | |
| 1,509,147 | A | 9/1924 | Holmes | |
| 2,031,345 | A | 2/1936 | Tinkham | |
| 2,330,572 | A | 9/1943 | Frey et al. | |
| 2,748,735 | A | 6/1956 | Slaten | |
| 3,848,497 | A | 11/1974 | Lancaster et al. | |
| 4,165,669 | A | 8/1979 | Brown et al. | |
| 4,623,089 | A | 11/1986 | Scott | |
| 5,025,691 | A * | 6/1991 | Deni | 83/140 |
| 6,109,159 | A | 8/2000 | Seto | |
| 2007/0261466 | A1 * | 11/2007 | Lee et al. | 72/405.03 |

FOREIGN PATENT DOCUMENTS

| | | | |
|---|---|---|---|
| DE | 19911486 | A1 | 11/1999 |
| EP | 1445042 | A | 8/2004 |
| EP | 1759782 | A | 3/2007 |
| GB | 134372 | A | 11/1919 |
| GB | 1221052 | A | 2/1971 |
| GB | 2118888 | A | 11/1983 |
| JP | 57154331 | A | 9/1982 |

OTHER PUBLICATIONS

Written Opinion, dated Jul. 10, 2008 for PCT Application No. PCT/US2008/068324, 6 pages.
Patent Cooperation Treaty, International Search Report, Sep. 29, 2008 (4 pages).
DE 19911486, English Abstract (1 page).
EP 1759782, English Abstract (1 page).
JP 57154331, English Abstract (1 page).

* cited by examiner

*Primary Examiner* — Debra Sullivan
(74) *Attorney, Agent, or Firm* — Fredrikson & Byron, P.A.

(57) ABSTRACT

The invention involves a multi-drive tool for use on a fabricating press having a table with multiple stations. Each station can include a mount opening passing through the table. The multi-drive tool can have a bridge member relating to at least two drive members such that a ram stroke of the press simultaneously moves the drive members or components thereof in a direction toward the workpiece. The invention also involves a die shoe adapted for use on a press. A die-mounting recess configured to receive a die is formed in the top of the die shoe. The invention also provides a fabricating press in combination with a multi-drive tool, as well as methods of fabricating a workpiece.

52 Claims, 18 Drawing Sheets

MULTI-DRIVE TOOLING

FIELD OF THE INVENTION

The present invention relates generally to tooling for industrial presses. Specifically, this invention relates to tooling for fabricating presses, methods of fabricating sheet metal and other workpieces, and tooling set-ups for fabricating presses.

BACKGROUND OF THE INVENTION

Presses are used extensively in fabricating sheet metal and other workpieces. Many different fabricating presses are available. For example, a variety of turret presses can be used. Typically, these presses have an upper turret that holds a series of upper tools at locations spaced circumferentially about its periphery, and a lower turret that holds a series of lower tools at locations spaced circumferentially about its periphery. With such a press, the turrets can be rotated about a vertical axis to bring a desired tool set into vertical alignment at a work station. By rotating such upper and lower turrets, an operator can bring a number of different tool sets sequentially into alignment at the work station in the process of performing a series of different fabricating operations.

Platen-type presses can also be used. Typically, these presses have a square or rectangular platen that holds a plurality of tools at multiple stations spaced about the platen. The press has a ram that can be positioned over any station of the platen. Pivatic is one well-known manufacturer of platen-type presses.

Multi-tools have been devised for presses. Multi-tools allow a number of different tools to be available at a single station of the press. Thus, instead of having a single punch at a desired station of the press, a multi-tool carrying a number of different punches can be provided at the desired station. With a multi-tool of this nature, any of the punches carried in the multi-tool can be selected and indexed to an operable position. Then, when a ram of the press acts on the multi-tool, only the selected (or "activated") punch is moved forcefully into engagement with the workpiece.

In conventional press operations, when the ram is actuated, it only acts on the tooling at a single station of the press. This is the case whether the station is equipped with a multi-tool or a single tool. This can be appreciated by referring to FIG. 2, which illustrates the arrangement of stations on one particular turret press. Here, the turret press has 58 stations, each shown as a circle representing a mount opening passing through the upper turret table. (Skilled artisans will appreciate that virtually any arrangement of stations can be provided.) With a turret press of this nature, the ram can be positioned over any desired station, at which point the ram is actuated so as to accelerate a tool mounted at the desired station. This causes the accelerated tool to strike and deform the workpiece.

The same is true of platen-type presses. FIG. 15 illustrates an exemplary arrangement of stations on a platen-type press. (Here again, virtually any arrangement of stations can be provided. In addition, the shape of the platen will vary.) With a platen-type press of this nature, the ram can be positioned over any desired station, at which point the ram is actuated so as to accelerate a tool mounted at the desired station, causing the accelerated tool to strike and deform the workpiece.

Thus, with current tooling, a single ram stroke only actuates one station of the press. It would be desirable to provide tooling that allows a single ram stroke to simultaneously actuate multiple stations. Such tooling would create a wide range of new fabrication opportunities.

As one example, conventional tooling has limitations as to the maximum size of the deformation (hole, bend, form, etc.) that can be made in a single operation (e.g., in a single hit). For instance, if a desired deformation is longer than the workpiece-deforming surfaces of a conventional tool set, then multiple operations may be required to create the full length of the deformation. This is inefficient and costly, since it may require multiple hits, multiple tool sets, or even multiple machine tools to produce the desired deformation. A very long form, for example, cannot be made by a single hit with conventional tooling on a turret press or a platen-type press. Thus, it would be desirable to provide tooling that allows large forms (and other large deformations) to be made by a single ram stroke on such presses.

SUMMARY

Some embodiments of the invention provide a press and multi-drive tool in combination. The press has a table with multiple stations each including a mount opening passing through the table. The press has a ram. The ram and the table are adapted for relative movement such that the ram can be selectively aligned with different stations of the table. The multi-drive tool has a tip section. In the present embodiments, the multi-drive tool includes a plurality of drive members received in respective mount openings of plural stations of the table. The multi-drive tool has a bridge member connected to at least one of the drive members and configured such that in response to a ram stroke of the press the drive members are actuated simultaneously.

In some embodiments, the invention provides a method of fabricating a workpiece. The method involves a multi-drive tool mounted operatively on a press. The press has a table with multiple stations each including a mount opening passing through the table. The press has a ram. The ram and the table are adapted for relative movement such that the ram can be selectively aligned with different stations of the table. In the present embodiments, the multi-drive tool includes a plurality of drive members received in respective mount openings of plural stations of the table. The multi-drive tool has a bridge member connected to at least one of the drive members. The multi-drive tool includes a tip section located at a leading end region of at least one of the drive members. The present method comprises operating the ram to initiate a ram stroke. The bridge member is configured such that the ram stroke simultaneously actuates the drive members and causes the tip section to bear forcibly against and deform the workpiece.

In certain embodiments, the invention provides a multi-drive tool for use on a press having a table with multiple stations each including a mount opening passing through the table. The multi-drive tool has a tip section adapted to bear forcibly against and thereby deform a workpiece. The multi-drive tool includes two drive members adapted for being received in respective mount openings of two stations of the table. The multi-drive tool has a bridge member connected to at least one of drive members and being configured such that a ram stroke of the press simultaneously actuates the drive members.

Some embodiments of the invention provide a multi-drive tool for use on a press having a table with multiple stations each including a mount opening passing through the table. The multi-drive tool has a tip section adapted to bear forcibly against and thereby deform a workpiece. The multi-drive tool includes two drive members adapted for being received in respective mount openings of two stations of the table. In the present embodiments, the drive members are at least generally parallel to each other. The multi-drive tool has a bridge member connected to at least one of drive members and being configured such that a ram stroke of the press simultaneously actuates the drive members. In the present embodiments, at least one of the drive members preferably is configured to be a floating drive member such that when the multi-drive tool is operatively assembled the floating drive member has at least a limited range of lateral freedom of motion relative to the bridge member.

In certain embodiments, the invention provides a die shoe adapted for use on a press having a table. The die shoe has a bottom, a top, an inside end, an outside end, and two lateral sides. The die shoe is configured to mount on the table, and a die-mounting recess is formed in the top of the die shoe. The die-mounting recess is configured to receive a die. And the die-mounting recess is elongated in a direction extending either between the two lateral sides or between the inside and outside ends of the die shoe.

DETAILED DESCRIPTION OF PREFERRED EMBODIMENTS

Figure 1:
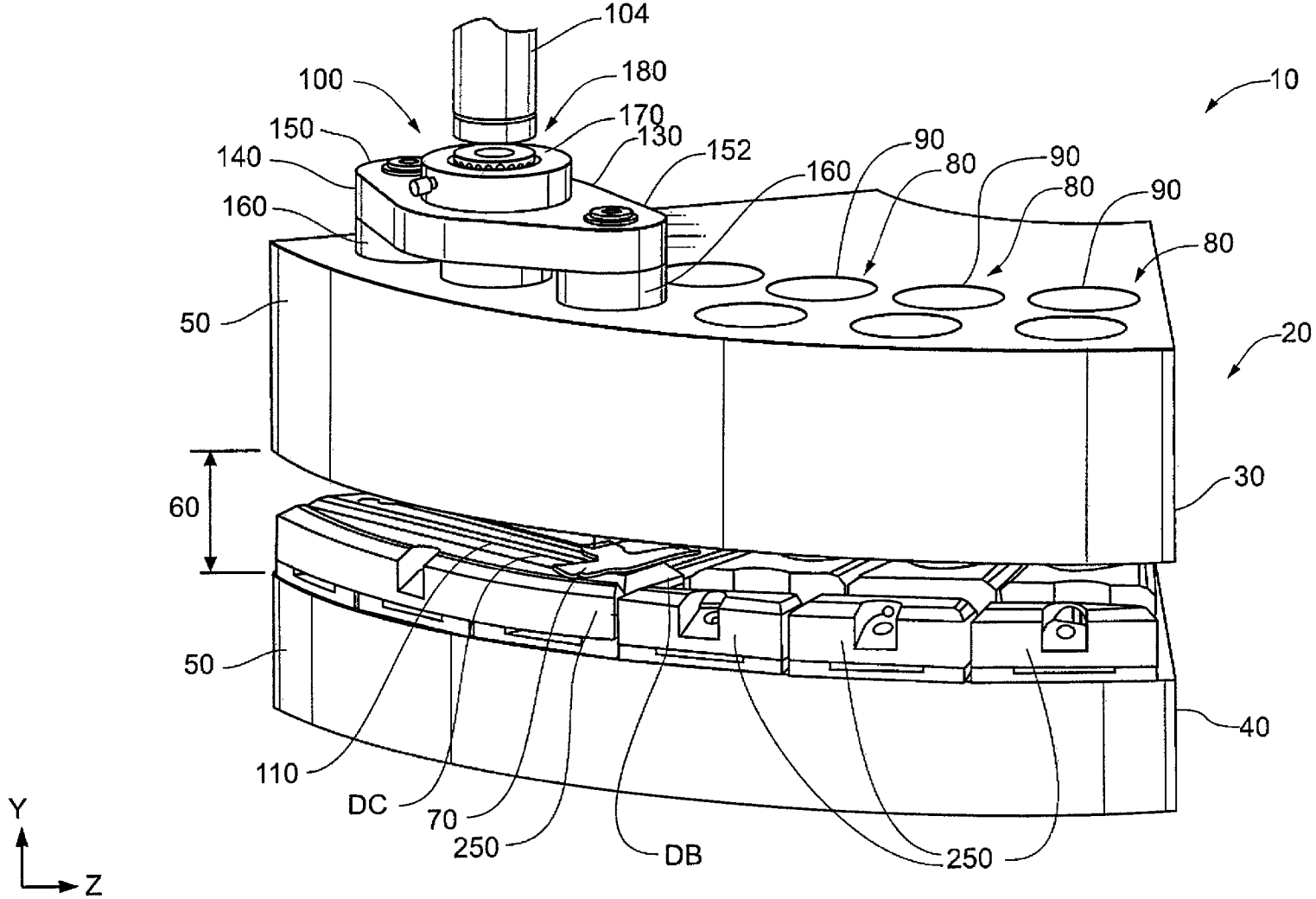
FIG. 1 is a broken-away partial perspective view of a fabricating press in accordance with an embodiment of the invention.

The following detailed description is to be read with reference to the drawings, in which like elements in different drawings have like reference numerals. The drawings, which are not necessarily to scale, depict selected embodiments and are not intended to limit the scope of the invention. Skilled artisans will recognize that the given examples have many useful alternatives, which fall within the scope of the invention.

Figure 15:
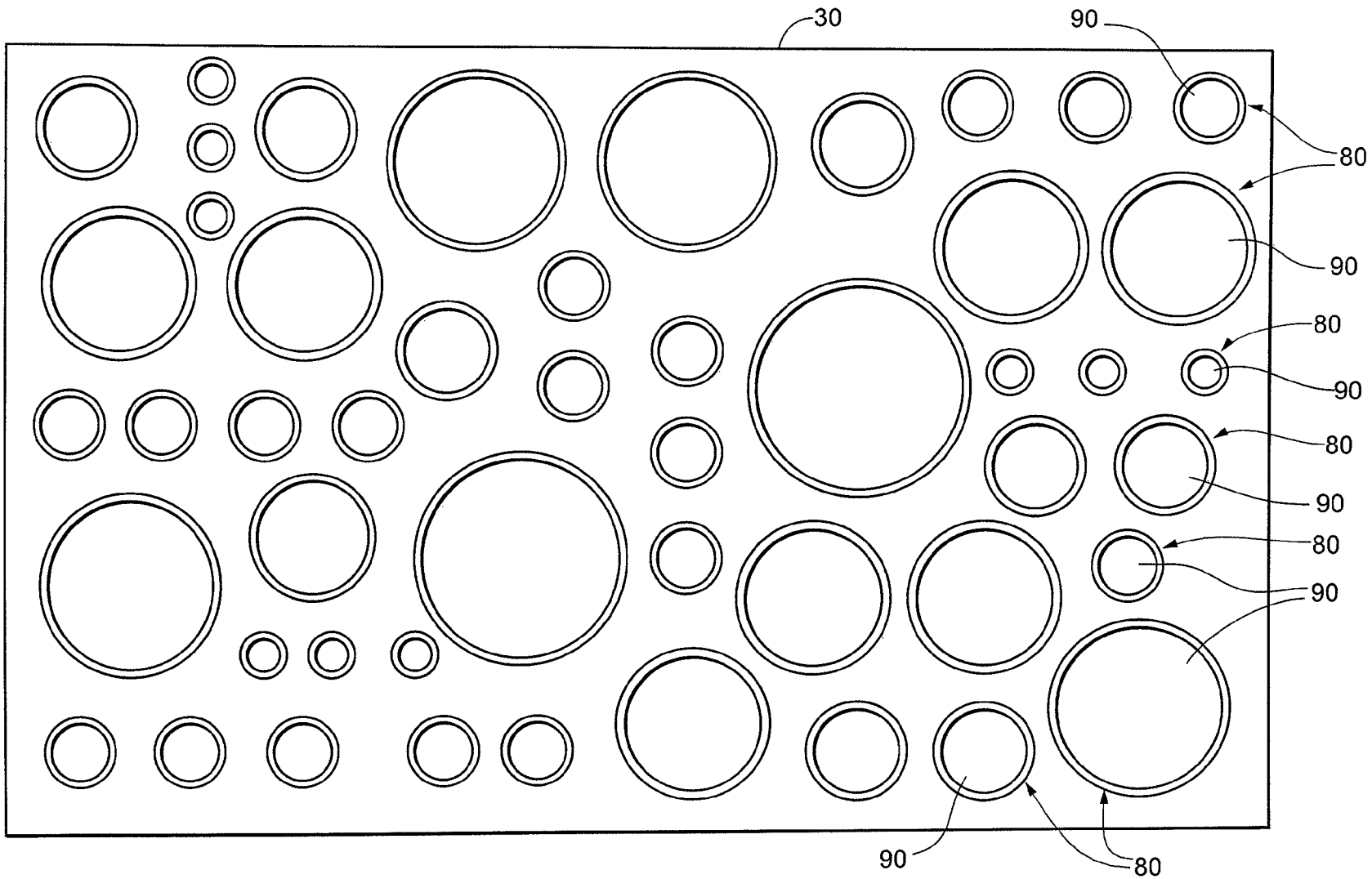
FIG. 15 is a top plan view of a table of a platen-type press in accordance with an embodiment of the invention.
Figure 16:
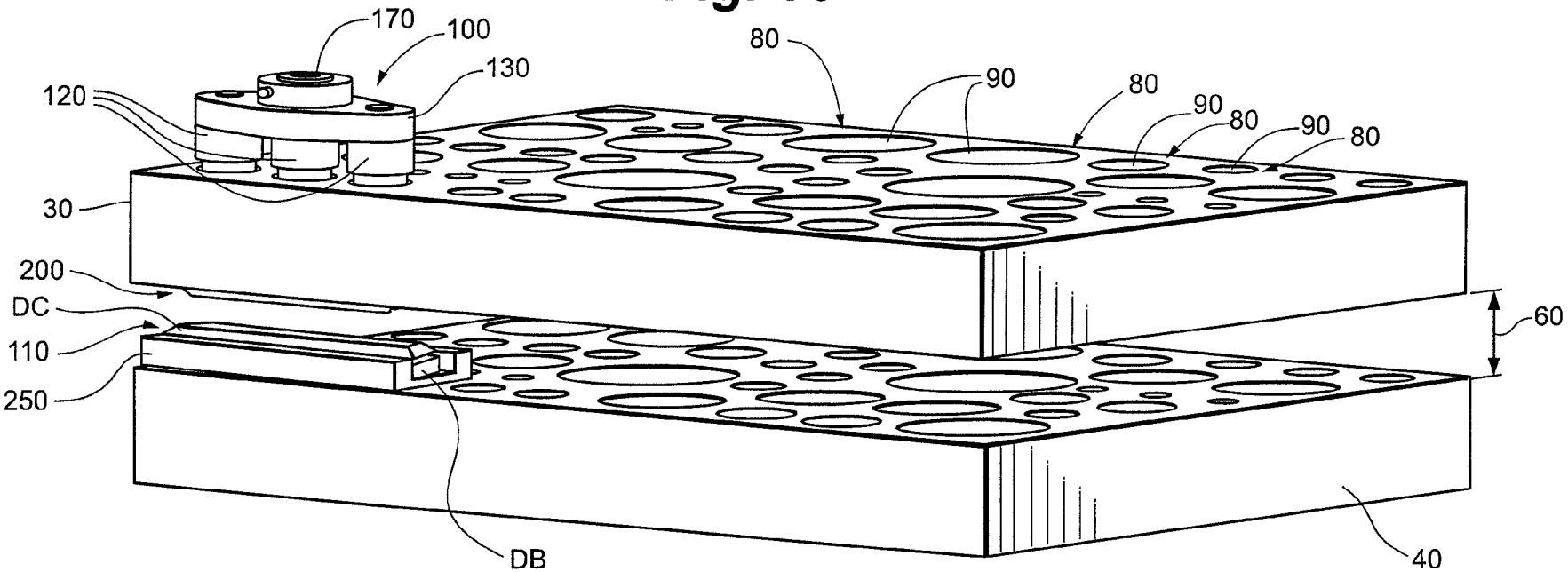
FIG. 16 is a schematic perspective view of a platen-type press, a multi-drive tool, a die shoe, and a die assembly in accordance with an embodiment of the invention.

A portion of one type of fabricating press is shown in FIG. 1. Here, the press 10 is a turret press 20. Alternatively, the press 10 can be a platen-type press, such as those available commercially from Pivatic (Hyvinkaa, Finland). Reference is made to FIGS. 15 and 16.

More generally, the fabricating press 10 can be any multi-station press useful for fabricating sheet-like workpieces, such as sheet metal or other metal or non-metal parts. In many cases, the press 10 will have a table 30 (optionally a horizontal table) with a plurality of spaced-apart stations 80. Commonly, the press 10 will have a ram 104. In such cases, the ram 104 and the table 30 preferably are adapted for relative movement such that the ram can be selectively aligned with different stations of the table. For example, the ram may be adapted to move relative to the table, the table may be adapted to move relative to the ram, or both. This relative movement preferably allows the ram to be selectively aligned with (e.g., positioned directly above) any one of the stations on the table.

Typically, each station 80 comprises a mount opening 90 passing through the table (optionally passing vertically through the table). The press 10 will commonly include spaced-apart tables (e.g., upper 30 and lower 40 tables) with a gap 60 formed therebetween. The fabrication process itself can include any work step, such as punching holes, creating bends, forms, etc.

For embodiments involving a turret press 20, the press can include an upper table (e.g., an upper turret) 30 and a lower table (e.g., a lower turret) 40. In some cases, the upper and lower tables each have a perimeter 50 and are rotatable about a central axis (e.g., a vertical axis) A. This is perhaps best appreciated by referring to FIGS. 1 and 2. In many cases, the upper and lower tables are both horizontal tables. The upper table 30 and lower table 40 commonly are separated by a turret gap 60. A sheet-like workpiece 70 is positioned in the gap 60 during operation (i.e., during fabrication). The upper and lower tables typically are adapted to rotate together to allow any desired tool set to be moved into position to act on the workpiece.

Figure 2:
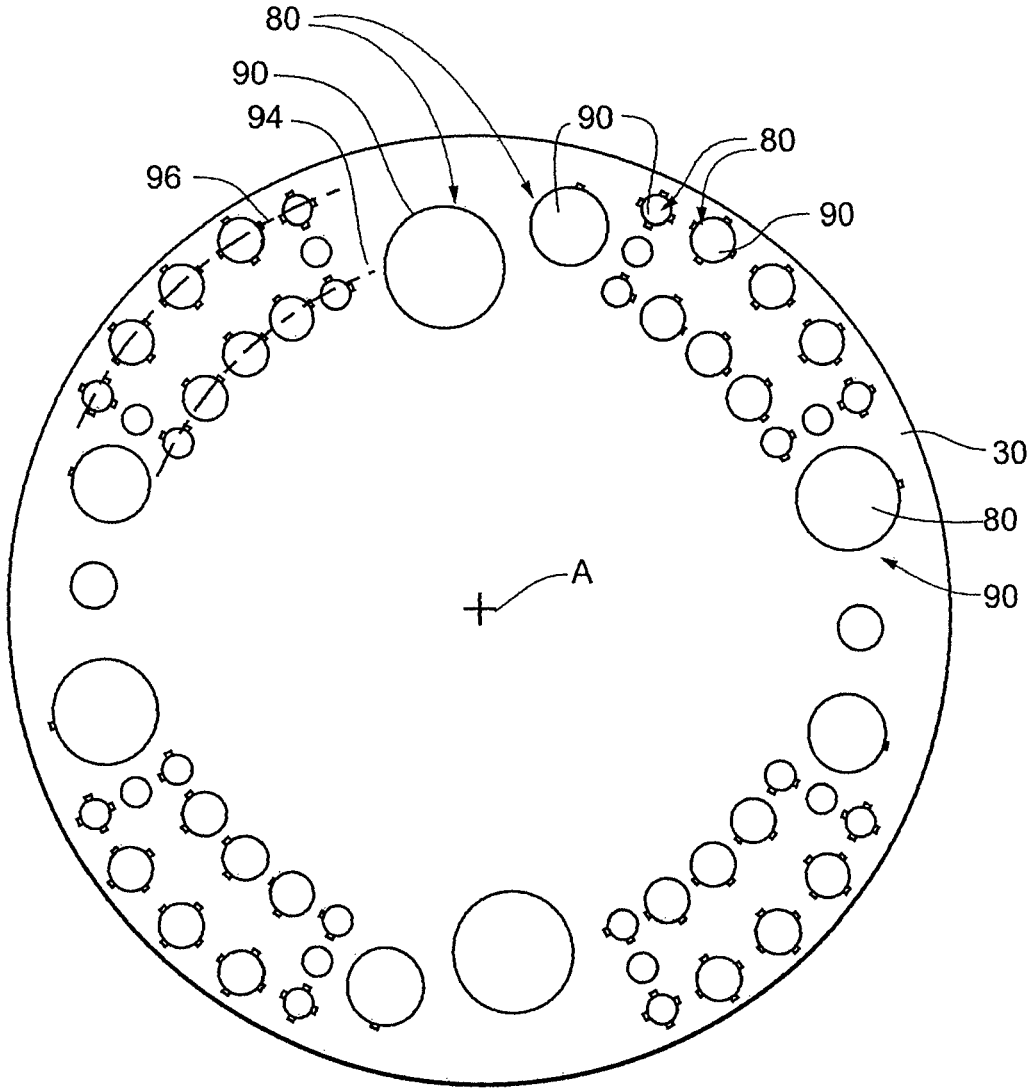
FIG. 2 is a top plan view of a table in accordance with an embodiment of the invention.

The turret press 20 includes a plurality of stations 80, each commonly having a mount opening 90 passing through (e.g., opening vertically through) the upper turret table. In some embodiments, groups of stations 80 are arranged in multiple tracks. For example, the upper table may include a plurality of stations forming an inner track 94 and another plurality of stations forming an outer track 96. In such cases, the stations of the inner track are closer to the central axis A of the press 20 than are the stations of the outer track. For example, the inner track stations may all be located (i.e., centered) substantially the same distance from the central axis of the press. Likewise, the stations of the outer track may all be located substantially the same distance from the central axis of the press. FIG. 2 depicts one exemplary arrangement of this nature. It is to be appreciated, though, that the turret press in many cases will not have multiple tracks. More generally, the number, types, and locations of stations on a turret press will vary from machine to machine. Thus, the present embodiments are by no means limited to any particular arrangement of stations.

Metal sheets and/or other workpieces (including non-metal sheets and other workpieces requiring bends, holes, forms, or other fabrication) can be placed between the upper 30 and lower 40 tables, and a multi-drive tool 100 mounted on the upper table 30 can be made to act on the workpiece (e.g., by applying force from a ram 104 to the tool 100). Typically, this forces the workpiece against a die 110 on a lower table 40 of the press 10.

As shown in FIGS. 1, 3-8, 16, 17, and 18, some embodiments of the present invention provide a multi-drive tool 100 for use on a fabricating press 10. Preferably, the multi-drive tool 100 includes at least two drive members 120 adapted for being received in respective mount openings 90 of at least two stations on a table of the press. The multi-drive tool 100 preferably has a bridge member 130 that is connected to at least one of the drive members 120 and that is configured such that a ram stroke (e.g., a single stroke) of the press 10 simultaneously actuates the drive members 120. This actuation may involve the drive members 120 moving (e.g., in their entirety) simultaneously, e.g., in a direction toward the workpiece 70, optionally in a downward direction. This is the case for embodiments like those of FIGS. 1, 3-6, 16, and 18. Alternatively, actuation may simply involve one or more components and/or moveable portions of each drive member 120 moving, e.g., toward a workpiece and/or relative to the table 30. This is the case for embodiments like those of FIGS. 7, 8, and 17. Thus, a single stroke of the ram 104 can simultaneously actuate multiple drive members, which are received in respective mount openings 90 of multiple stations 80. The resulting movement of the drive members 120, or moveable portions thereof, will commonly be relative to the table 30, which typically remains substantially stationary during a ram stroke.

Figure 17:
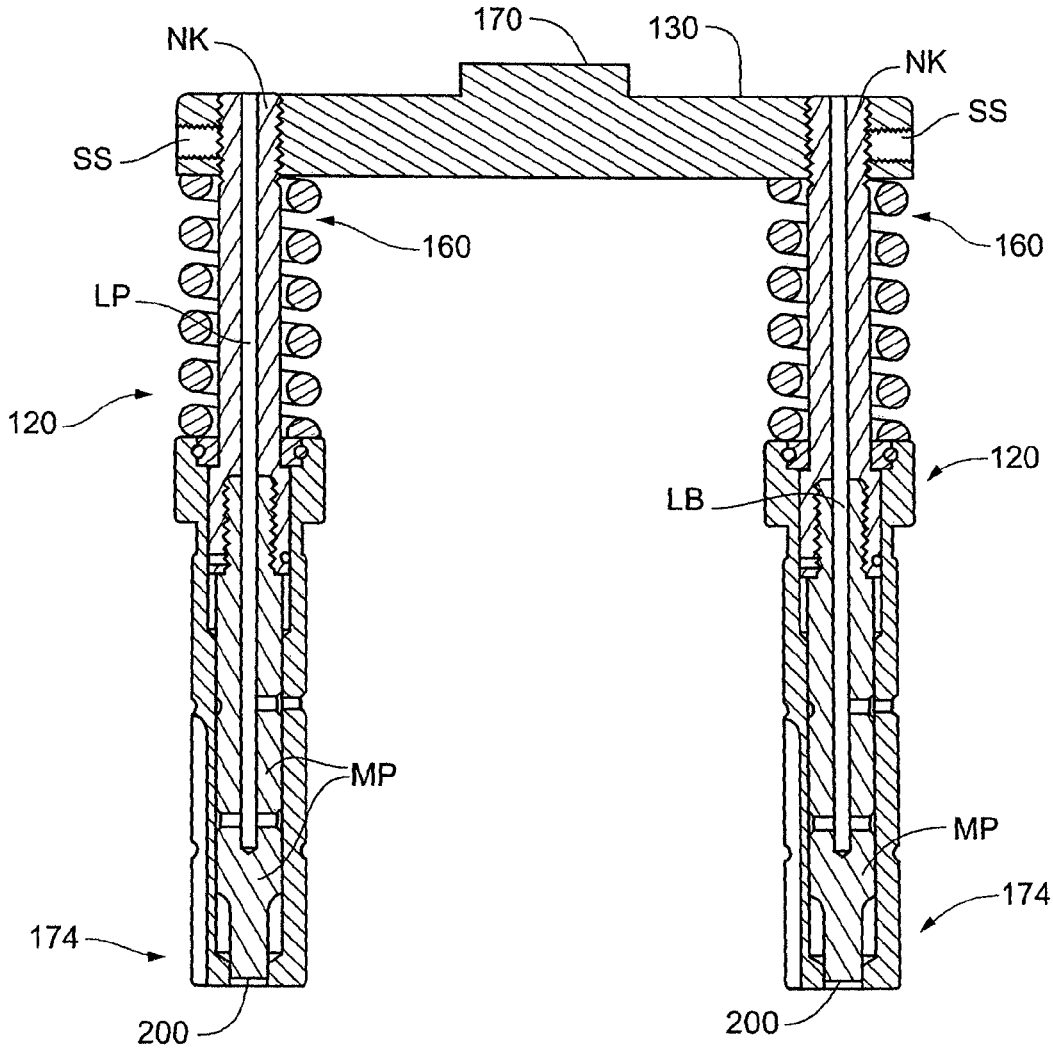
FIG. 17 is a cross-section view of a multi-drive tool in accordance with an embodiment of the invention.

Referring to FIG. 17, when a ram stroke actuates the drive members 120 of this particular multi-drive tool 100, a component and/or moveable portion of each drive member 120 moves relative to the table 30 of the press 10. The moveable component or portion of the drive member 120, for example, may comprise a punch MP, as shown in FIG. 17. Here, the illustrated punch MP is an adjustable-length punch comprising two rods threaded together. Exemplary punch assemblies of this nature are described in U.S. Pat. No. 5,131,303, the relevant teachings of which are incorporated herein by reference. The punch MP can alternatively be of a fixed length variety. In FIG. 17, set screws SS are used to rigidly secure necks NK of the drive members 120 to the bridge member 130. However, this is just one example of how such drive members may be joined to the bridge member. FIG. 17 is representative of embodiments wherein at least one drive member 120 of the tool 100 has an internal lubrication passage (optionally one in each drive member) for distributing lubrication (e.g., oil) through the tool. This feature can optionally be incorporated into any embodiment of the present tool. However, it is by no means required.

Figure 18:
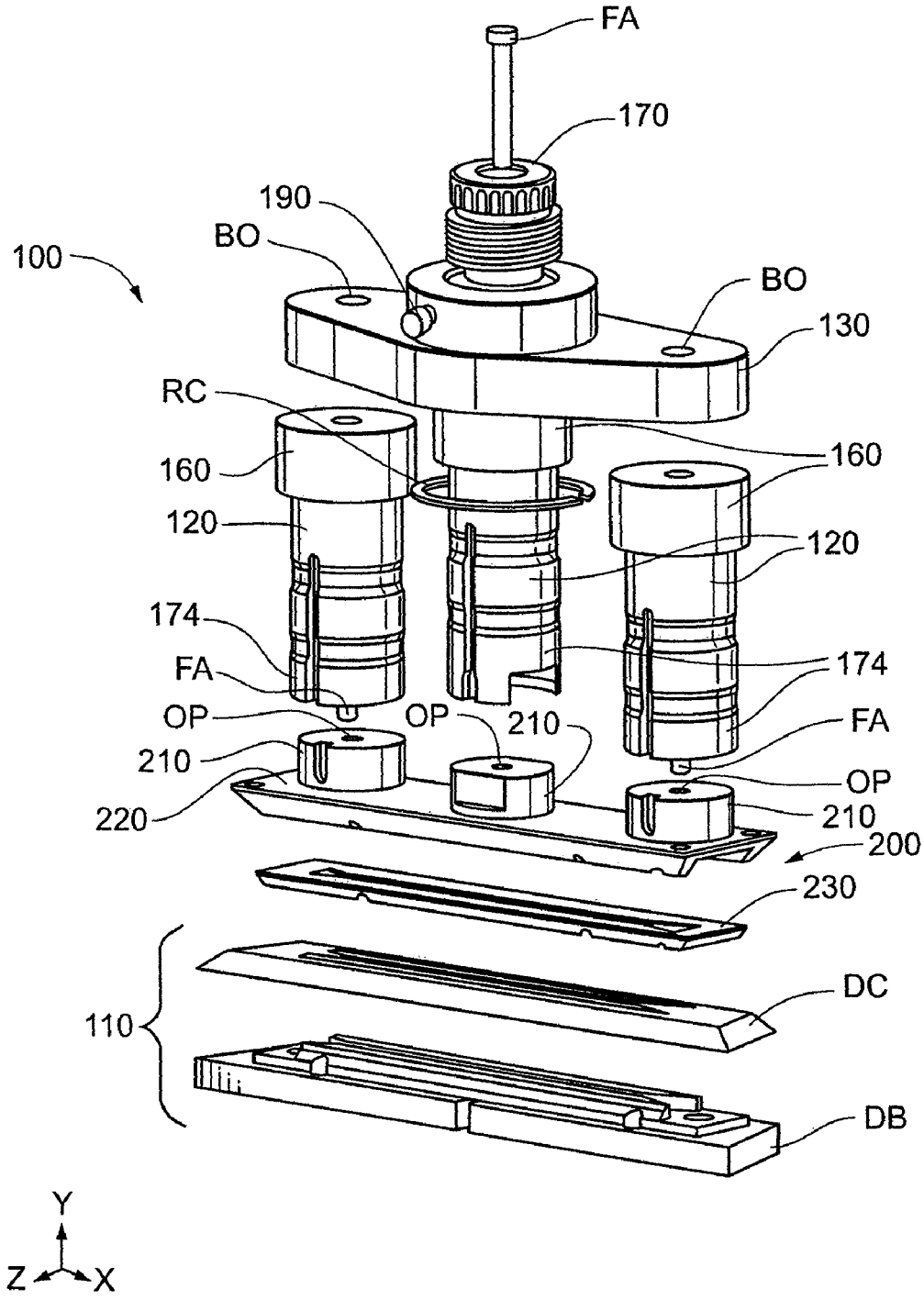
FIG. 18 is an exploded perspective view of a multi-drive tool and die assembly in accordance with an embodiment of the invention.

The bridge member 130 can relate to the drive members 120 in any manner that results in the drive members being actuated simultaneously in response to a ram stroke. Preferably, the bridge member 130 is coupled with (e.g., connected to) at least one of the drive members 120. For example, the bridge member 130 may be connected (e.g., directly connected) to each drive member 120. Alternatively, the bridge member may be connected to only one (or some) of the drive members 120. Reference is made to FIG. 18, of which more will be said later. In some cases, the bridge member 130 is connected to the drive members 120 such that the drive members are restrained against any substantial axial movement relative to the bridge member. This is the case for the tools 100 shown in FIGS. 1,3-6, and 16. In FIG. 18, the bridge member is only connected to a single drive member in this manner.

In certain embodiments, the bridge member 130 is rigidly connected to at least one of the drive members 120. For example, in FIG. 5, the center drive member 120 is rigidly connected to the bridge member 130. This is also the case for the center drive member 120 in FIG. 18. FIG. 17 depicts an exemplary embodiment wherein the bridge member 130 is rigidly connected to a plurality of (optionally all of the) drive members 120. Referring to FIG. 18, it can be seen that it is possible to have one or more of the drive members 120 not be directly attached to the bridge member (i.e., when the tool is operatively assembled).

The bridge member 130 itself can optionally comprise a rigid body. This rigid body may, for example, define a plurality of openings in which respective necks NK of multiple drive members can be secured. These particular features, however, are by no means required.

In certain embodiments, the bridge member 130 comprises a rigid elongated body (e.g., a rigid plate, block, or beam) 140. The rigid body preferably is connected to at least one of the drive members 120. In some embodiments, the rigid body connects a plurality of (optionally all of the) drive members 120. As is perhaps best shown in the exploded view of FIG. 4, the elongated body 140 can have a major dimension extending between first and second ends 150, 152. In such embodiments, a first drive member can be attached to the elongated body 140 adjacent the first end 150, and a second drive member can be attached to the elongated body 140 adjacent the second end 152. As already explained, the tool 100 may have two, three, or more drive members 120. Thus, the bridge member 130 may be connected to more than two drive members 120. For example, the bridge member in FIGS. 1, 3, 4, and 16 bridges three drive members, and the bridge member in FIG. 8 bridges six drive members. The bridge member 130 can optionally be connected to respective trailing end regions 160 of the drive members 120. In FIG. 18, the bridge member is connected to the trailing end region 160 of the center drive member 120, but the trailing end regions 160 of the two outside drive members 120 are not directly attached to the bridge member. Many other variants of this nature will be apparent to skilled artisans given the present teaching as a guide.

Figure 4:
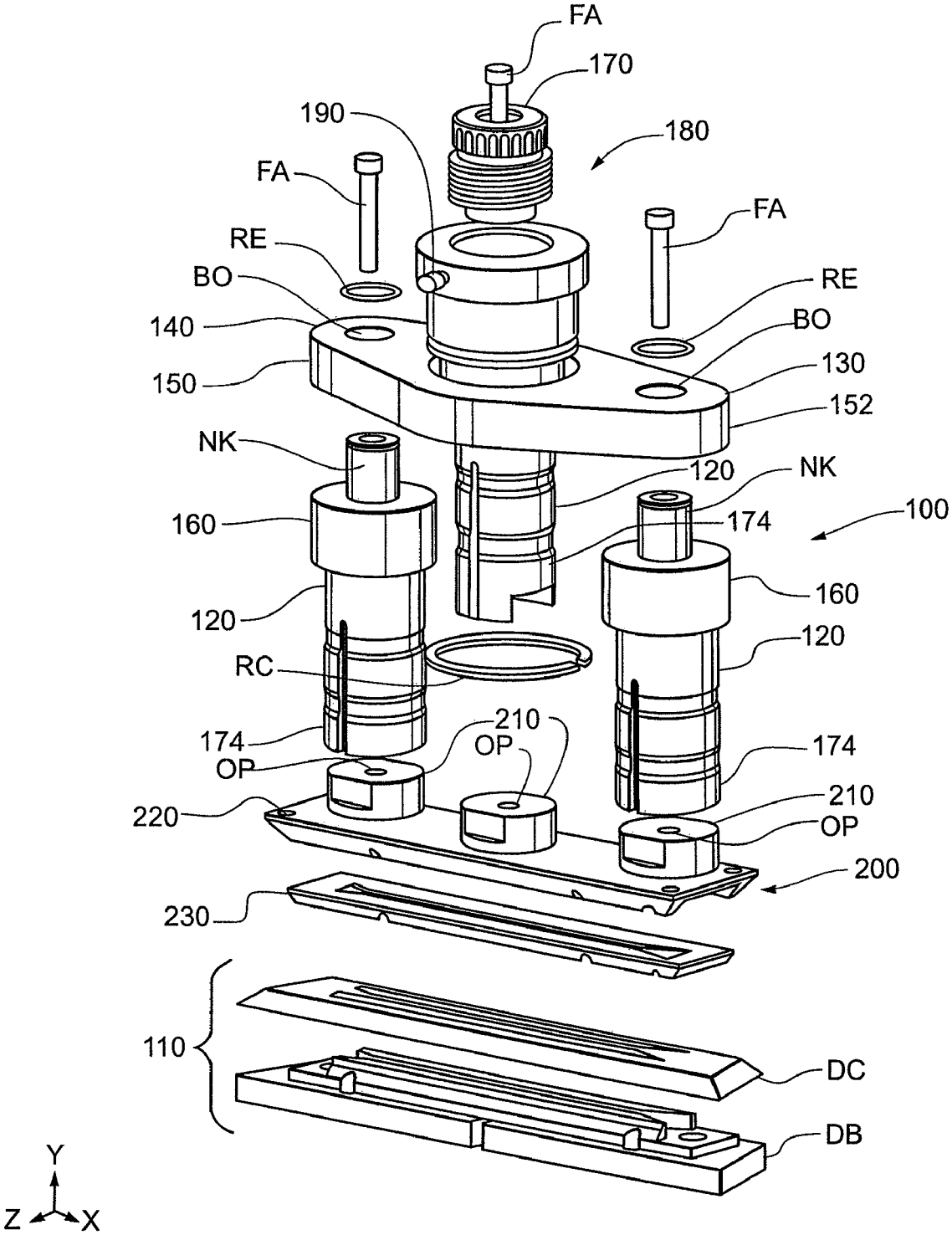
FIG. 4 is an exploded perspective view of a multi-drive tool and die assembly in accordance with an embodiment of the invention.

One group of embodiments provides a multi-drive tool 100 having at least one floating drive member. Referring to FIG. 4, it can be appreciated that the outer two drive members 120 when operatively coupled with (optionally being connected to) the bridge member 130 have some freedom to move laterally (e.g., radially) relative to the bridge member. Here, this is accomplished by providing the necks NK of these drive members with outer diameters smaller than the inner diameters of the bridge member openings BO in which the necks NK are received. The diameter of each neck NK preferably is smaller than the diameter of the opening BO by at least 0.004 inch. This is representative of embodiments wherein the tool 100 includes at least one drive member 120 coupled with (optionally being connected to) the bridge member 130 so as to have a radial freedom of motion (relative to the bridge member) of at least 0.002 inch. In the exemplary embodiment of FIG. 4, retainer rings RE are provided on the ends of the necks NK to secure the bridge member 130 to the driver members. These features, however, are merely exemplary.

FIG. 18 exemplifies another manner of providing the tool 100 with at least one floating drive member 120. Here, the two outer drive members are floating drive members, and they are not connected directly to the bridge member 130. However, the trailing end of each floating drive member is adjacent to (e.g., abuts) the bridge member, such that the bridge member delivers actuating force directly to the trailing end of each floating drive member in response to a ram stroke.

In FIG. 18, the center drive member is rigidly connected to the bridge member. The same is true of the embodiment shown in FIG. 4. This is representative of a group of embodiments wherein the multi-drive tool 100 includes at least one floating drive member and at least one drive member connected rigidly to the bridge member. In some of these embodiments, all of the drive members (even the floating one(s)) are restrained against any substantial axial movement relative to the bridge member.

Figure 5:
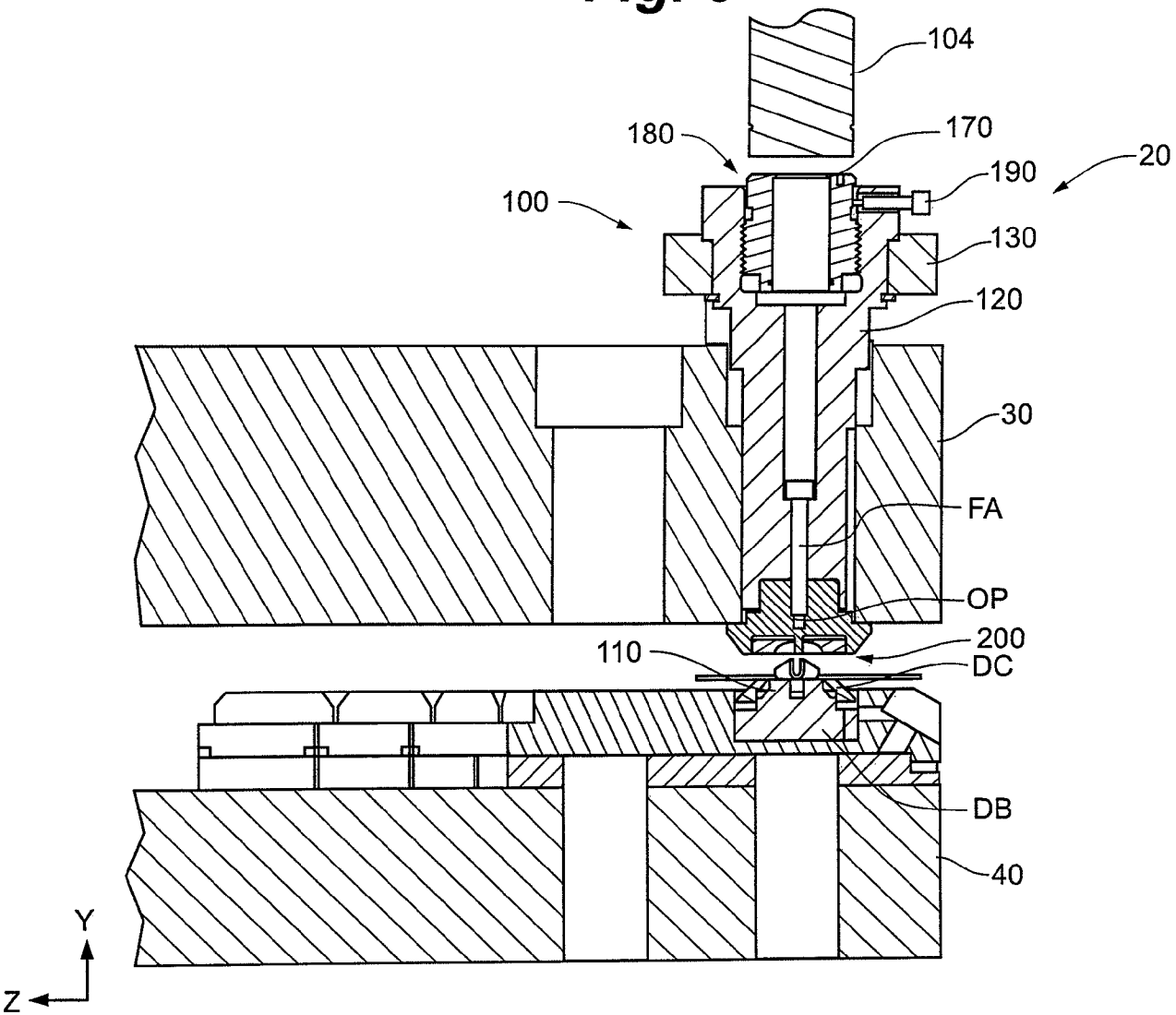
FIG. 5 is a broken-away plan cross-section view of a turret press, a multi-drive tool, and a die assembly in accordance with an embodiment of the invention.

The bridge member 130 and drive members 120 can relate to each other and the press 10 in any operative orientation. As shown in FIGS. 1, 5, and 16 the drive members 120 can extend vertically through respective mount openings 90, and the bridge member 130 can extend horizontally between such vertical drive members 120. In certain embodiments, when the multi-drive tool 100 is operatively mounted on an upper table of a press 10, the bridge member 130 is retained above the upper table, and the drive members 120 extend downwardly from the bridge member toward a lower table 40 of the press. Thus, the bridge member 130 in these embodiments is adapted to be retained above the upper table when the multi-drive tool is mounted operatively on the press (and at all times during operation). This is perhaps best appreciated by referring to FIGS. 1, 5, and 16. In some embodiments, the drive members 120 are at least generally parallel to each other, and the bridge member 130 is at least generally perpendicular to the drive members 120. This, however, is not strictly required.

In the embodiments of FIGS. 1, 3-8, 16, 17, and 18, the multi-drive tool 100 has a head 170 adapted to receive force from a ram 104 of the press. In such embodiments, during a ram stroke, force is delivered from the ram 104 to the head 170 of the tool 100. This force is transferred to each drive member 120 (or to one or more components of each drive member) via the bridge member 130, thereby causing simultaneous actuation of the drive members 120.

The drive members 120 themselves can have any suitable shape. In some embodiments, the drive members 120 comprise elongated shafts that move axially (e.g., within respective mount openings 90) in response to a ram stroke. The illustrated drive members 120 have generally cylindrical configurations, although this is not strictly required. As noted above, the drive members 120 can include trailing end regions 160 proximate (optionally attached to) the bridge member 130. The drive members 120 can also include leading end regions 174, as discussed further below. Any number of drive members can be provided, such as two (see FIGS. 6-7), three (see FIGS. 1, 3, 4, 16, and 18), or more (see FIG. 8). In alternate embodiments, one or more of the drive members are integral, or permanently joined, to the bridge member. Further, in some embodiments, the multi-drive tool includes more than one bridge member. Other variants will be apparent to skilled artisans given the present disclosure as a guide.

As shown best in FIGS. 4 and 5, certain embodiments of the multi-drive tool 100 have a height-adjustment mechanism 180. When provided, this mechanism allows the height of the multi-drive tool 100 to be changed by adjusting the height-adjustment mechanism 180. In some embodiments, the height-adjustment mechanism 180 comprises a head 170 of the tool 100. Thus, adjusting the height-adjustment mechanism can optionally involve rotating a head 170 of the tool (e.g., relative to the bridge member 130 and/or relative to one or more drive members). The tool 100, for example, can be provided with a head 170 that can be threadingly engaged with the bridge member 130 and/or with the trailing end region 160 of a drive member 120 (optionally a center drive member). In embodiments like those of FIGS. 4 and 5, the distance between the top of the head 170 and the leading end of the center drive member can be adjusted by rotating the head 170 relative to the center drive member (the rotation here is also relative to the bridge member 130, although this is not strictly required). This has the effect of adjusting the effective length of all the drive members (since this changes the distance between a first plane that is flush with the top of the head 170 and a second plane that is parallel to the first plane and passes through the leading ends of the drive members). This type of height-adjustment mechanism makes it unnecessary to separately adjust the length of each drive member. This is also true for the embodiments of FIGS. 6-8. It is to be appreciated, however, that the multi-drive tool 100 is not required to have any height-adjustment mechanism, much less one that employing a head of the tool. For instance, FIG. 18 provides a plurality of height-adjustment mechanisms incorporated into respective drive members 120.

When provided, the height-adjustment mechanism can advantageously include a lock mechanism 190 for selectively preventing rotation of the head 170, e.g., relative to the bridge member 130 and/or relative to a drive member to which the head 170 may be coupled. The lock mechanism 190 may include, for example, a biased pin or set screw. This is best seen in FIGS. 4 and 5.

When provided, the head 170 of the multi-drive tool 100 can optionally be integral to the bridge member 130. One embodiment of this nature is shown in FIG. 17. Here, the head 170 does not provide for adjusting the height of the tool 100. However, the drive members 120 each have a height adjustment mechanism. This allows the height of each drive member to be adjusted independently. An integral head like that in FIG. 17 could alternatively be replaced with a non-adjustable head comprising a discrete body or assembly that is rigidly attached to the bridge member. Further, it is anticipated that some tool designs will not have any head (e.g., the ram may strike the bridge member and/or a drive member).

Figure 6:
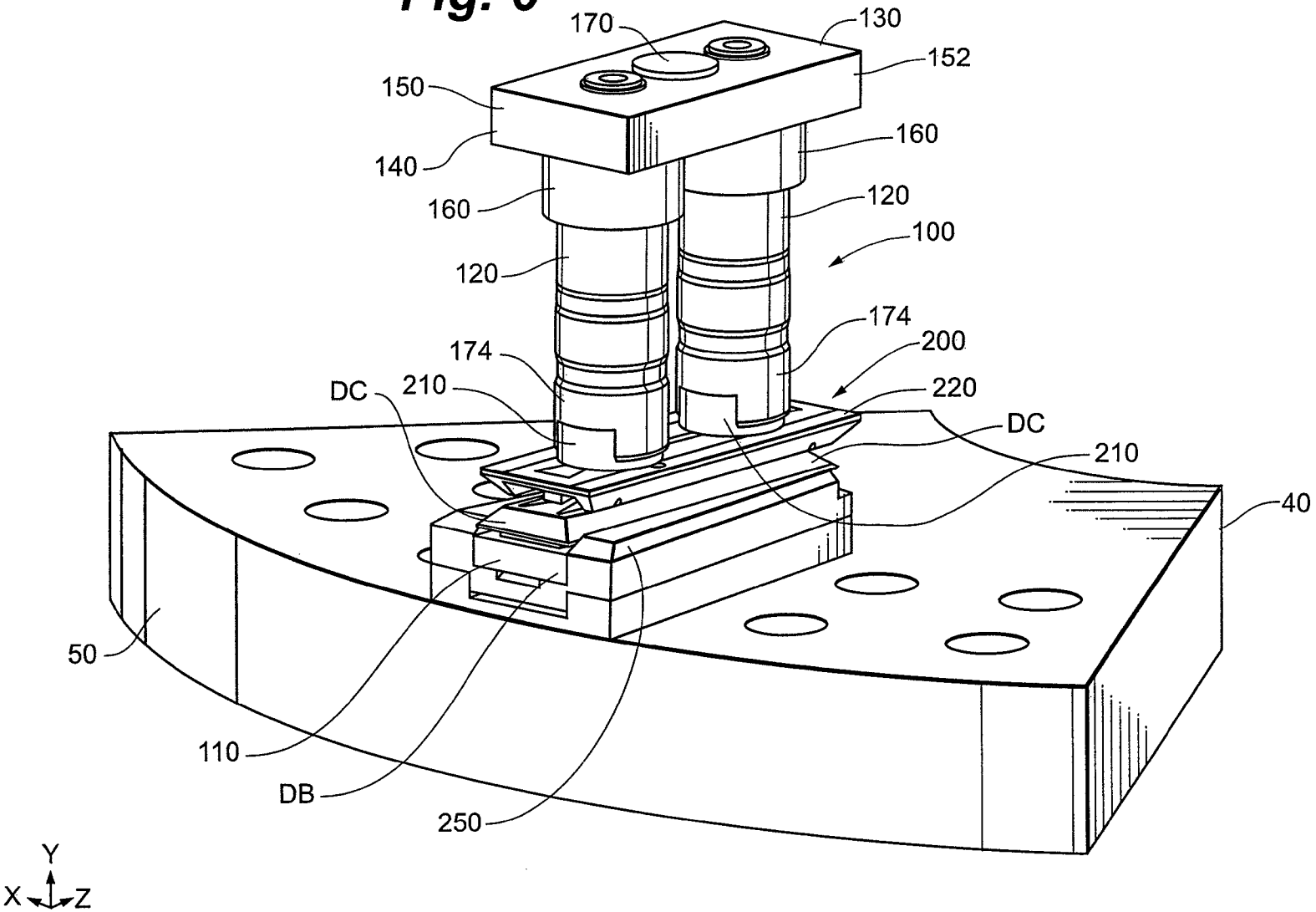
FIG. 6 is a schematic broken-away perspective view of a multi-drive tool and lower turret table in accordance with an embodiment of the invention.
Figure 7:
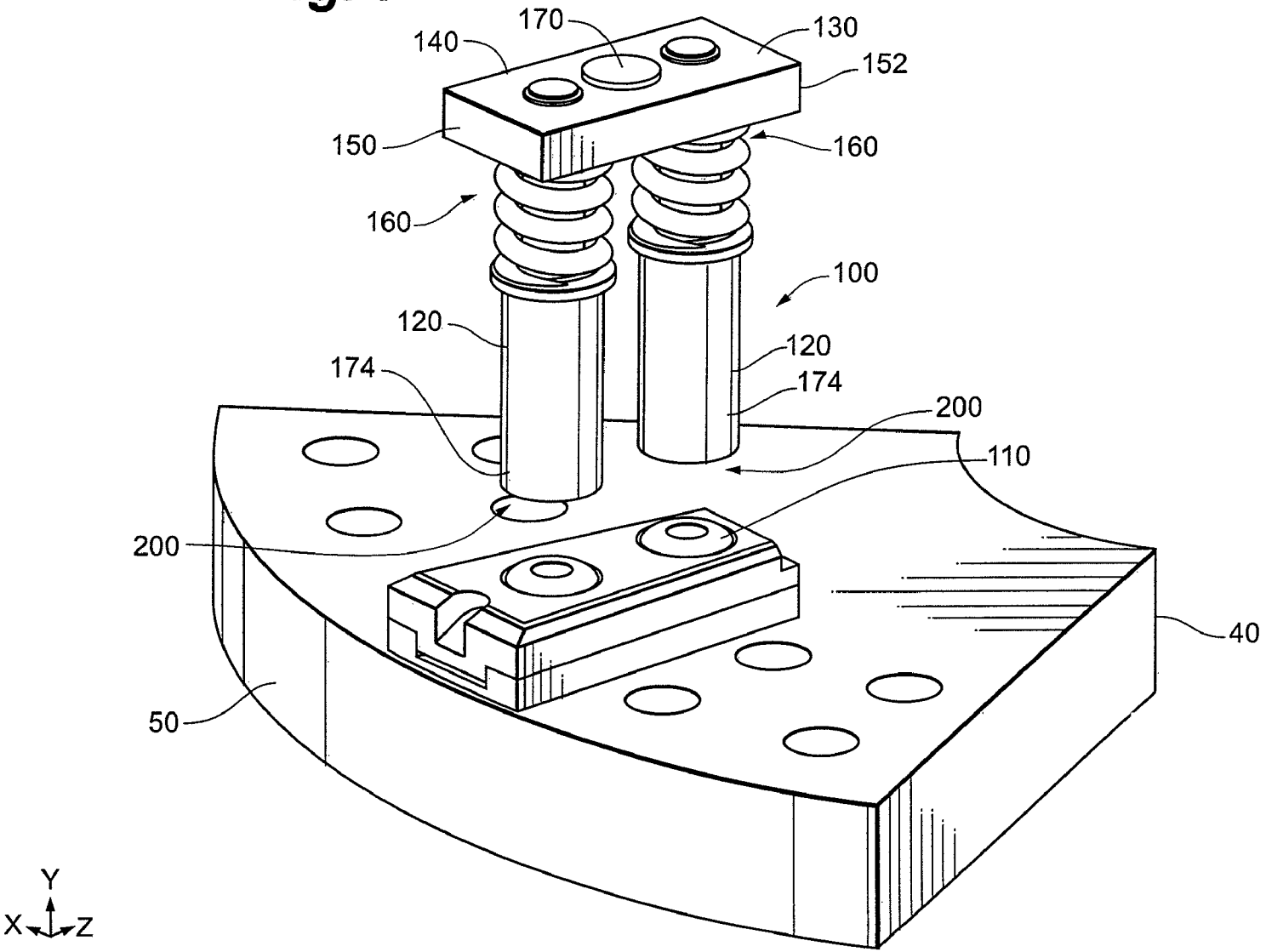
FIG. 7 is a schematic broken-away perspective view of a multi-drive tool and lower turret table in accordance with another embodiment of the invention.
Figure 8:
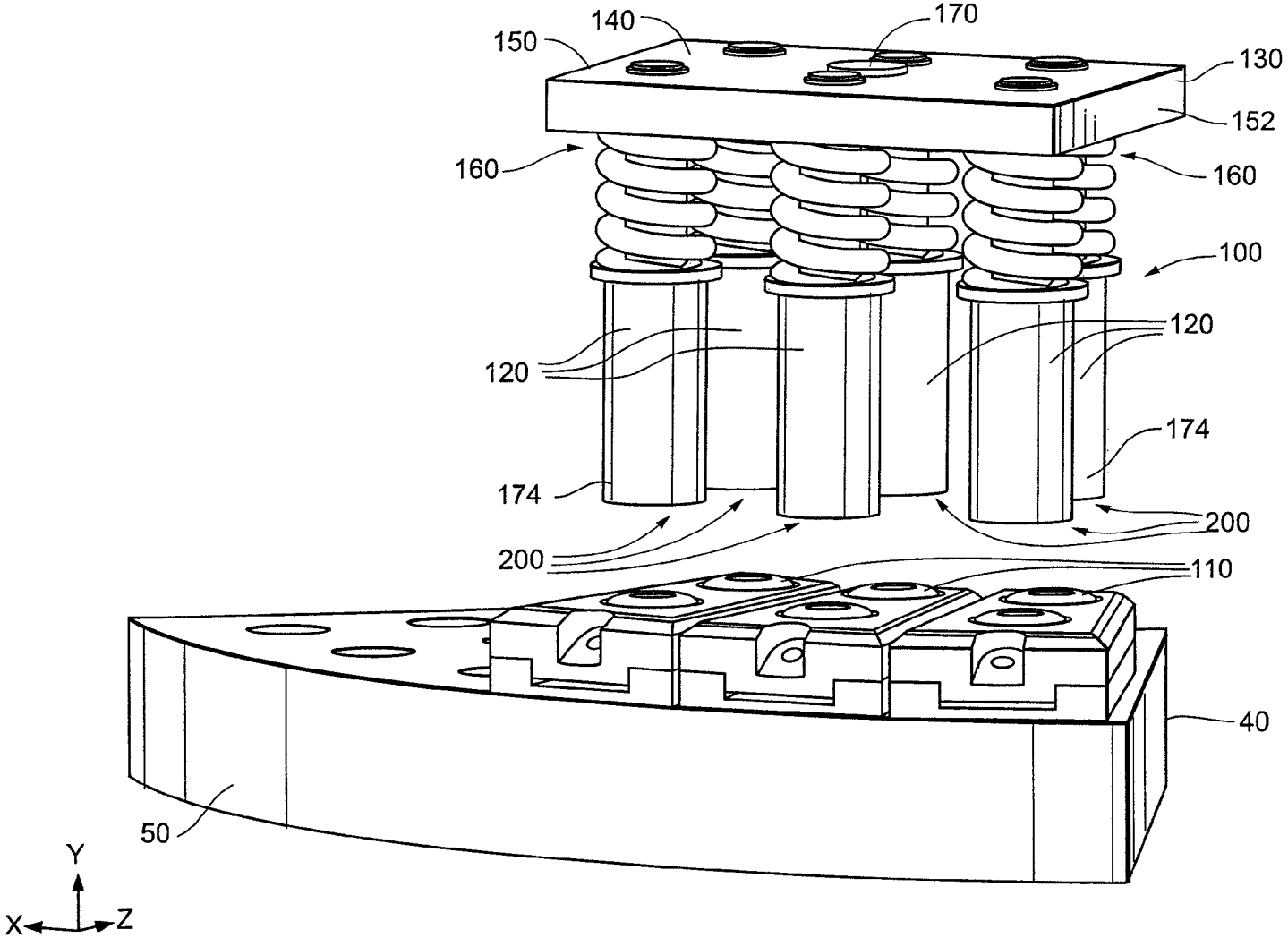
FIG. 8 is a schematic broken-away perspective view of a multi-drive tool and lower turret table in accordance with another embodiment of the invention.

As shown in FIGS. 3-10, 16, 17, and 18, the multi-drive tool 100 preferably includes at least one tip section 200 adapted to act upon a workpiece. The tip section(s) 200 can be adapted to bear forcibly against, and thereby deform, a workpiece when a force is applied to the multi-drive tool (e.g., by a ram 104). In some embodiments, the tool includes a tip section 200 located at a leading end region 174 of at least one of the drive members 120. In the embodiments of FIGS. 7, 8, and 17, the multi-drive tool 100 includes a plurality of (i.e., two or more) discrete tip sections 200 located at respective leading end regions 174 of the drive members 120. Such discrete tip sections are adapted to simultaneously create at least two spaced-apart deformations in the workpiece.

In embodiments like those shown in FIGS. 1, 3, 4, 6, 9, 16, and 18, the tip section 200 connects respective leading end regions 174 of multiple drive members 120. In these figures, the tip section 200 is at least generally perpendicular to the drive members 120, although this is not required. In certain embodiments, the tip section 200 is removably connected to respective leading end regions 174 of the drive members 120. For example, the tip section 200 may have (e.g., may define) a plurality of engagement portions 210 adapted to be joined to the leading end regions 174 of respective drive members 120. In such cases, the engagement portions 210 can be secured to the leading end regions 174 in any suitable manner, such as by compression fit, set screws, and/or other fasteners. As is perhaps best shown in FIGS. 4, 9 and 10, the illustrated engagement portions 210 are part of (e.g., integral to) a first tip piece 220. Here, a second tip piece 230 can be coupled to the first tip piece 220. This connection can be made in any suitable manner (using compression fit, set screws, other fasteners, etc.). The specific configuration of the tip piece, of course, will vary depending upon the particular type of deformation the tool is intended to create.

Figure 9:
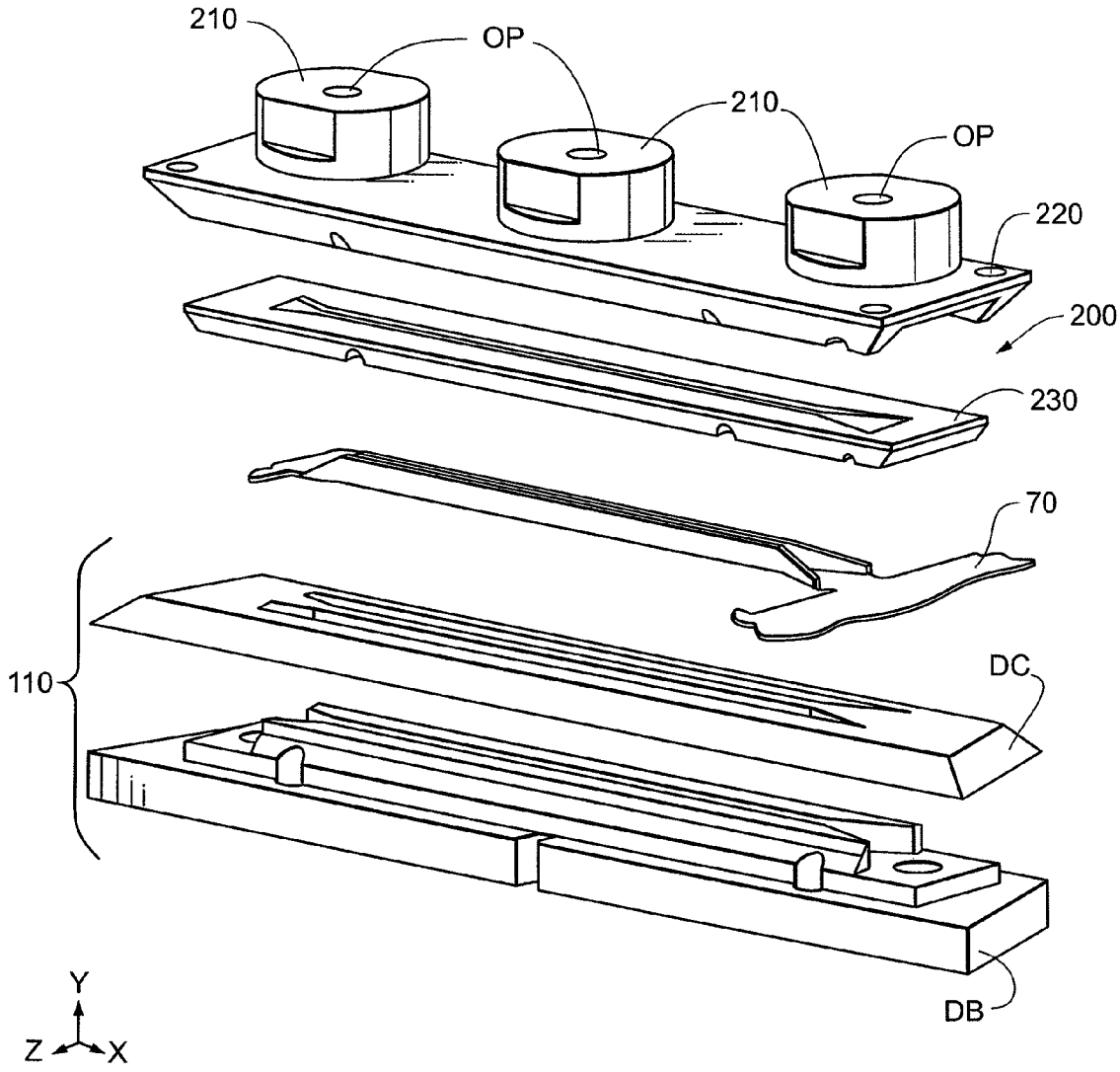
FIG. 9 is an exploded perspective view of a multi-drive tool tip section and die assembly in accordance with an embodiment of the invention.
Figure 10:
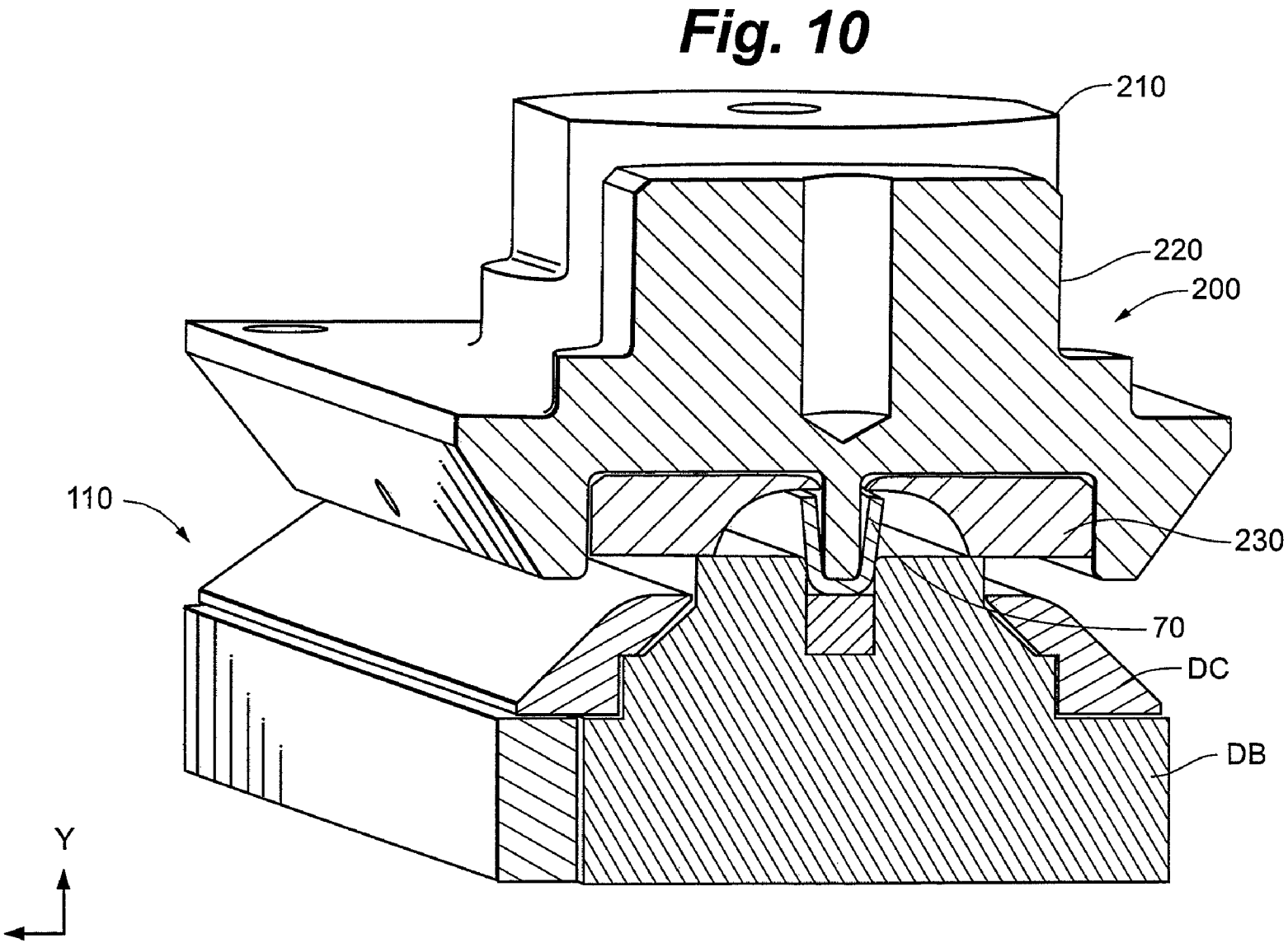
FIG. 10 is a perspective cross-section view of a multi-drive tool tip section and die assembly in accordance with an embodiment of the invention.

In one group of embodiments, the tip section 200 comprises an elongated body, and this elongated body has a plurality of engagement portions 210 each adapted to be mounted to a leading end of a drive member 120. Such engagement portions, for example, can be projections (e.g., male projections) or recesses that are adapted to be fitted against (e.g., so as to be attached removably to) the leading ends of respective drive members 120. For instance, the tip section 200 may comprise an elongated body with a plurality of male projections extending from a generally plate-like portion of the elongated body at locations spaced-apart along a length of the body. In some cases, the elongated body is a first tip piece 220, as shown in FIGS. 9 and 10. The elongated body, however, can take many other forms.

FIG. 5 shows one exemplary manner of attaching a tip section 200 to a drive member 120. Here, a fastener FA extends from the drive member 120 to the tip section 200. As is perhaps best seen in FIGS. 4 and 9, there are openings (e.g., threaded openings) OP formed in the tip section 200, and fasteners FA extending from the drive members 120 are anchored in these openings OP. Bolts or other conventional fasteners can be used. This, however, is just one example of how a tip section can be mounted removably to multiple drive members. Many other configurations can alternatively be used, so these features are by no means required.

In certain embodiments, the tip section 200 is retained below the table 30. For example, the embodiments of FIGS. 1, 3-6, 9, 10, 16, and 18 involve a tip section configured to be retained below the upper table 30 of a press 10 when the tool 100 is mounted operatively on the press (and at all times during operation). In some cases, the bottom of the upper table is provided with a relief in which the tip section is received when the tool is at rest. Optionally, the drive members 120 are at least generally parallel to each other, while the tip section 200 is at least generally perpendicular to the drive members 120.

The present invention makes it possible to use a multi-station press to fabricate designs that have previously been outside the scope of what could be done on a turret press, a platen-type press, etc. For example, some embodiments make it possible to create larger deformations than have previously been possible with conventional tooling for such presses.

In certain embodiments of the present invention, the multi-drive tool 100 has a tip section 200 adapted to create in the workpiece a deformation having a major dimension (e.g., a length) of greater than 4½ inches, greater than 6 inches, or greater than 8 inches. In these embodiments, a single hit of the tool against a workpiece produces a deformation having a major dimension within one or more of the noted ranges. One exemplary embodiment produces a deformation about 8-9 inches long.

FIGS. 1, 3-6, 9, 10, 16, and 18 depict embodiments wherein the tool 10 is adapted to specific type of deformation. For example, the tool 100 can alternatively be adapted to create a louver, a lance & form, long bends of various designs, etc. The ability to make long bends and/or forms is particularly advantageous. For example, it allows operators to use turret presses, platen-type presses and other multi-station presses to make deformations that previously required use of a press brake. The present tool 100 can also be adapted to punch long openings, multiple openings, etc. in a single hit. FIGS. 6, 7, and 17 show exemplary embodiments wherein the tool 100 is adapted to punch multiple holes in a workpiece in response to a single ram stroke. Thus, many punching, bending, and forming opportunities are possible with the present invention. For example, one could use the present multi-drive technology to set-up a turret press, a platen-type press, or another multi-station press to be a stamping machine. Skilled artisans will see many other fabrication possibilities given the present teaching as a guide.

Some embodiments of the invention provide a die shoe 250 adapted for use on a press 10. Preferably, the die shoe 250 mounts to a lower table 40 of the press, and is adapted to receive one or more dies. As is perhaps best seen in FIGS. 11-14, the die shoe can include a top 260, an inside end 262, an outside end 264, and two lateral sides 266, 268. In some embodiments (those involving a turret press), the die shoe is configured to be mounted on a lower turret table such that the inside end 262 faces a central axis of the table, while the outside end 264 faces a perimeter 50 of the table. In such embodiments, die shoe 250 can optionally have a minor width at the inside end 262 and a major width at the outside end 264. Thus, in some embodiments, the width of the die shoe is smaller at the inside end than at the outside end. For example, the width can generally increase (e.g., gradually) when moving from the inside end to the outside end. In some embodiments of this nature, the die shoe 250 has a generally pie-shaped configuration (in a cross section generally parallel to the bottom of the die shoe). Other embodiments, though, do not have these features. For example, the die shoe 250 of FIG. 14 has a rectangular shape, rather than a pie-shaped configuration.

Figure 11:
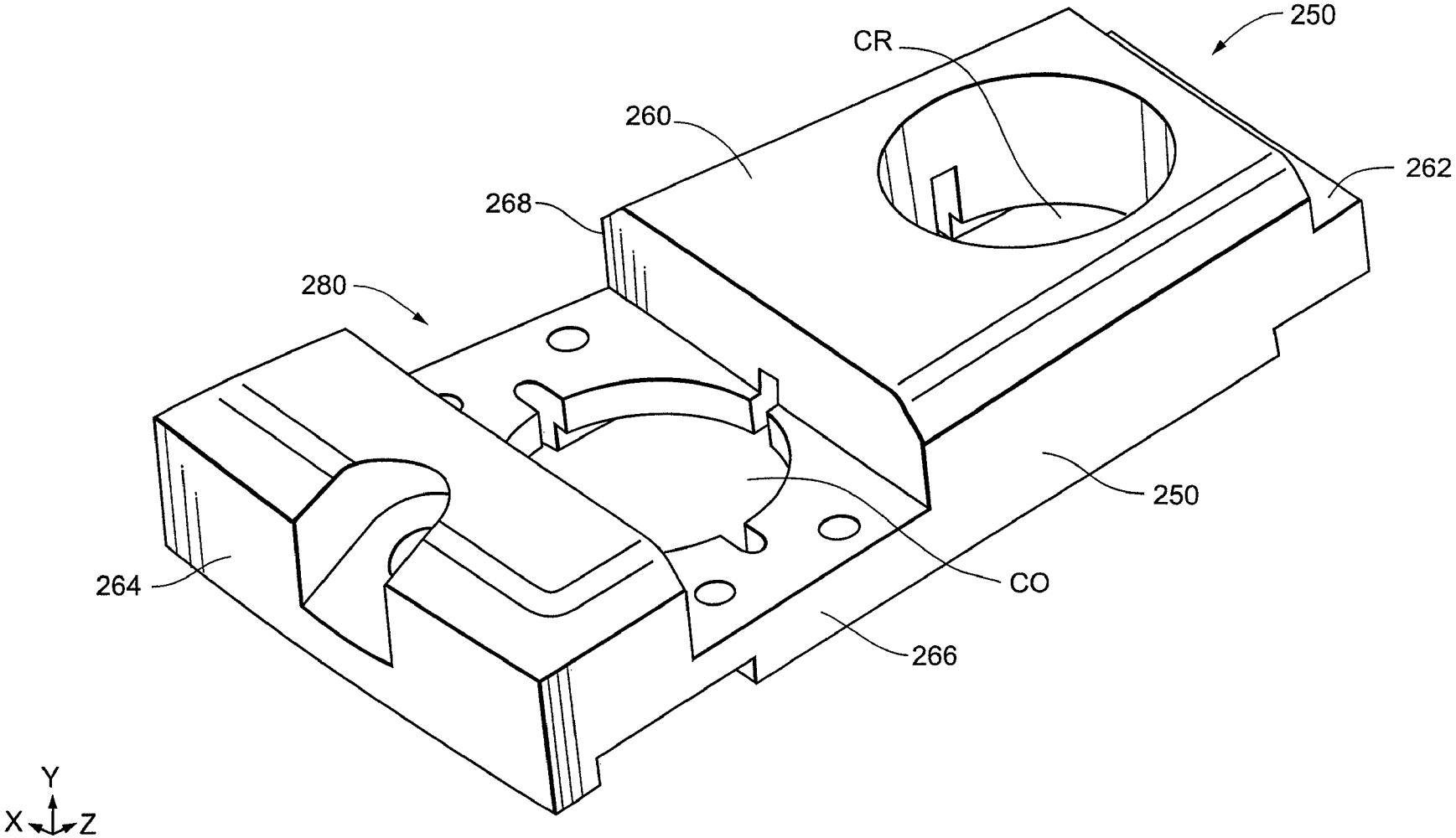
FIG. 11 is a perspective view of a die shoe in accordance with an embodiment of the invention.
Figure 12:
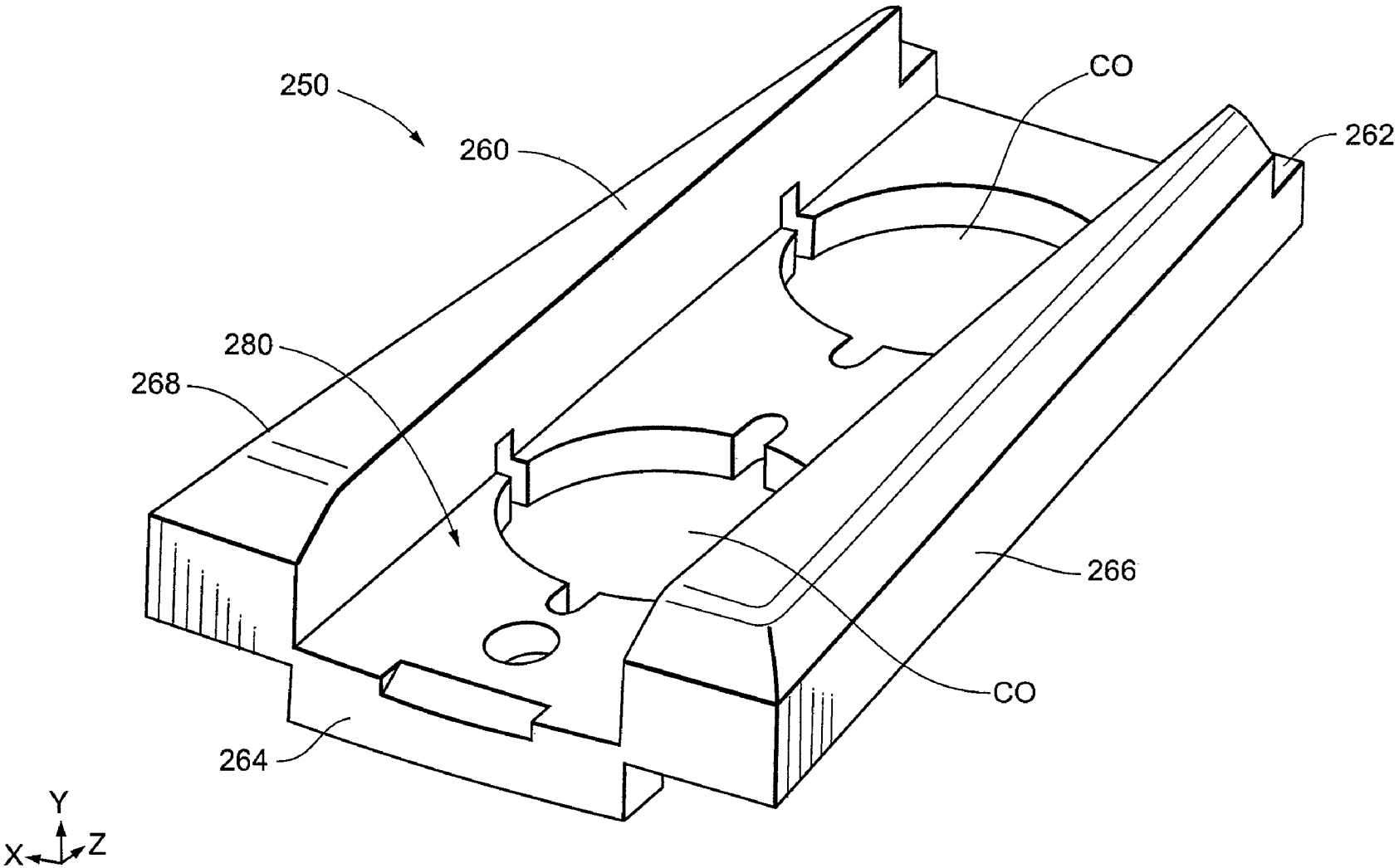
FIG. 12 is a perspective view of a die shoe in accordance with another embodiment of the invention.
Figure 13:
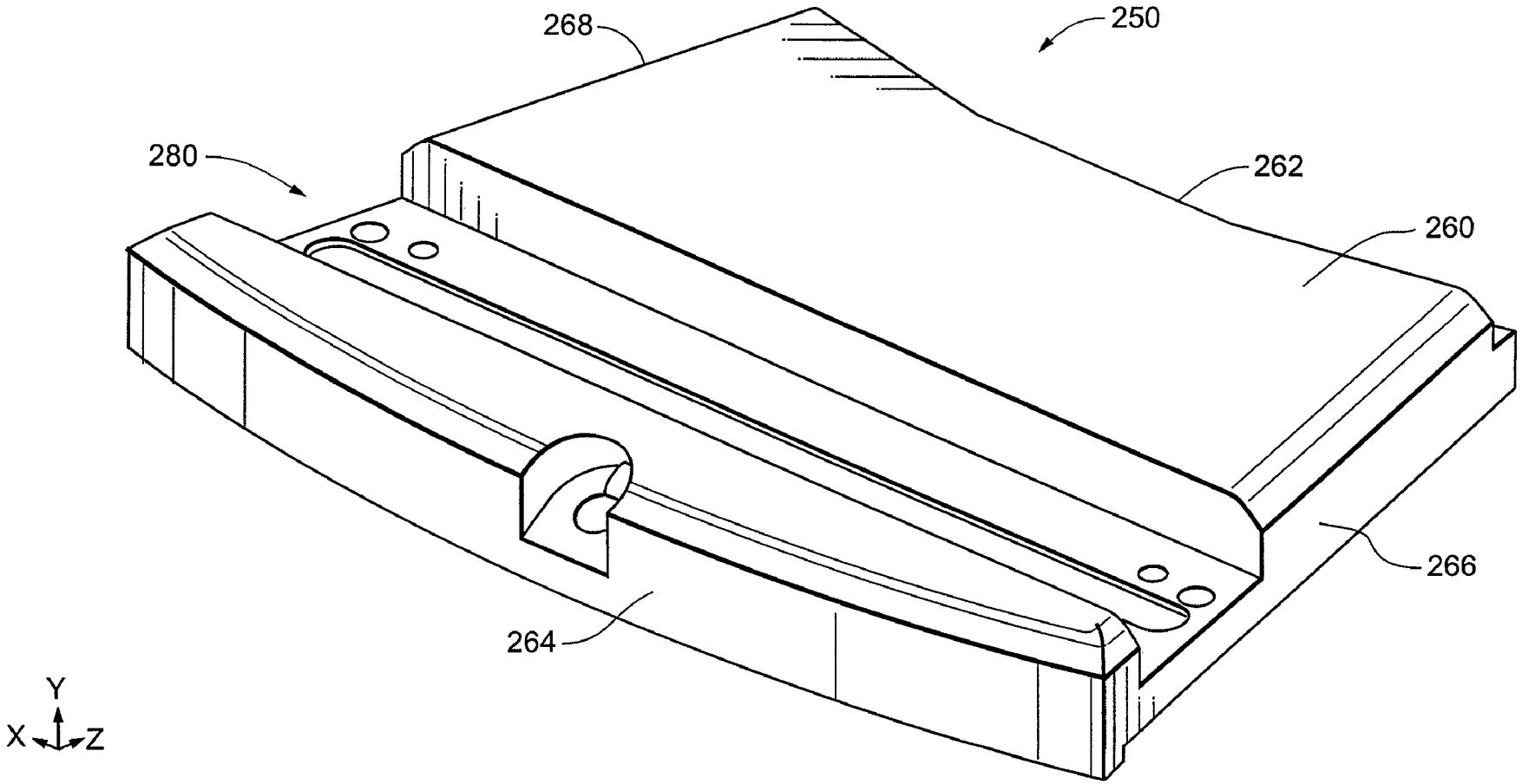
FIG. 13 is a perspective view of a die shoe in accordance with another embodiment of the invention.

Preferably, a die-mounting recess 280 is formed in the top of the die shoe 250. This recess 280 (which can optionally be a channel) is configured to receive a die 110. In some embodiments, the die-mounting recess 280 is elongated in a direction extending between the die shoe's two lateral sides (see FIGS. 11 and 13). In other embodiments, the die-mounting recess 280 is elongated in a direction extending between the inside 262 and outside 264 ends of the die shoe (see FIGS. 12 and 14). Embodiments like that of FIG. 12 provide a die-mounting recess 280 that spans multiple tracks 94 and 96. For example, the recess 280 in FIG. 12 is adapted to carry an elongated die, which when mounted on the lower table of an appropriate turret press is aligned with (e.g., is directly below) an inner-track station and an outer-track station.

Preferably, the die-mounting recess 280 extends at least partway across the die shoe 250. In some cases, the recess 280 extends at least substantially entirely across the die shoe, e.g., it may extend at least substantially entirely between either the two lateral sides or the inside and outside ends of the die shoe. In some cases, the recess 280 extends entirely across the die shoe—such that the recess is a channel with both ends open. Such a channel, for example, may be an elongated, generally rectangular channel. Due to the configuration of the die-mounting recess 280, the present die shoe 250 can optionally facilitate making long deformations in a workpiece with a single ram stroke.

Figure 3:
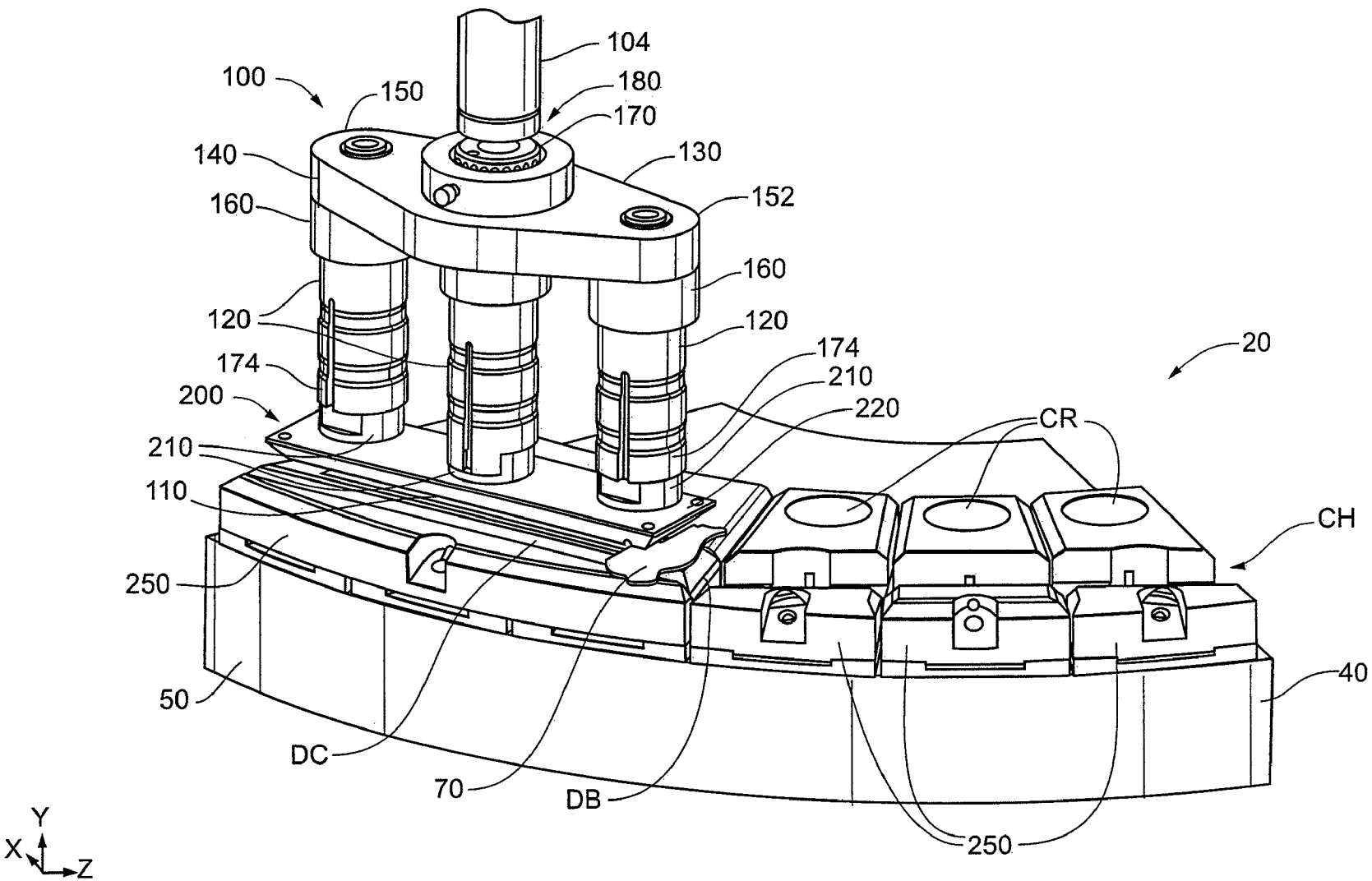
FIG. 3 is a schematic broken-away perspective view of a multi-drive tool and lower turret table in accordance with an embodiment of the invention.

Referring to FIG. 3, it can be seen that certain embodiments provide an assembly involving a plurality of die shoes mounted side-by-side on the lower table of a press (optionally a turret press). In some embodiments of this nature, an elongated channel CH extends across the tops of at least two side-by-side die shoes. For example, on the right side of FIG. 3, there are three die shoes each defining part of such a channel. Here, a single elongated die (optionally like the die shown in the large die shoe on the left side of FIG. 3) may occupy the channel CH, which is defined collectively by the noted side-by-side die shoes. An arrangement of this nature can alternatively involve two side-by-side die shoes, four side-by-side die shoes, etc. In some embodiments, one or more of these die shoes also has a circular die-mount recess CR adapted to receive a generally cylindrical (and/or generally disk-shaped) die. For example, each of the three die shoes on the right side of FIG. 3 has a generally circular die-mount recess CR spaced-apart from the channel CH. FIG. 11 depicts another die shoe or this nature. This, however, is not required. For example, the channel CH may be the only die-mounting recess in each die shoe. Further, the channel CH can alternatively be located adjacent to the inner end of the die shoe. In such cases, one or more of the die shoes can optionally have a circular die-mount opening adjacent to the outer end of the die shoe.

Figure 14:
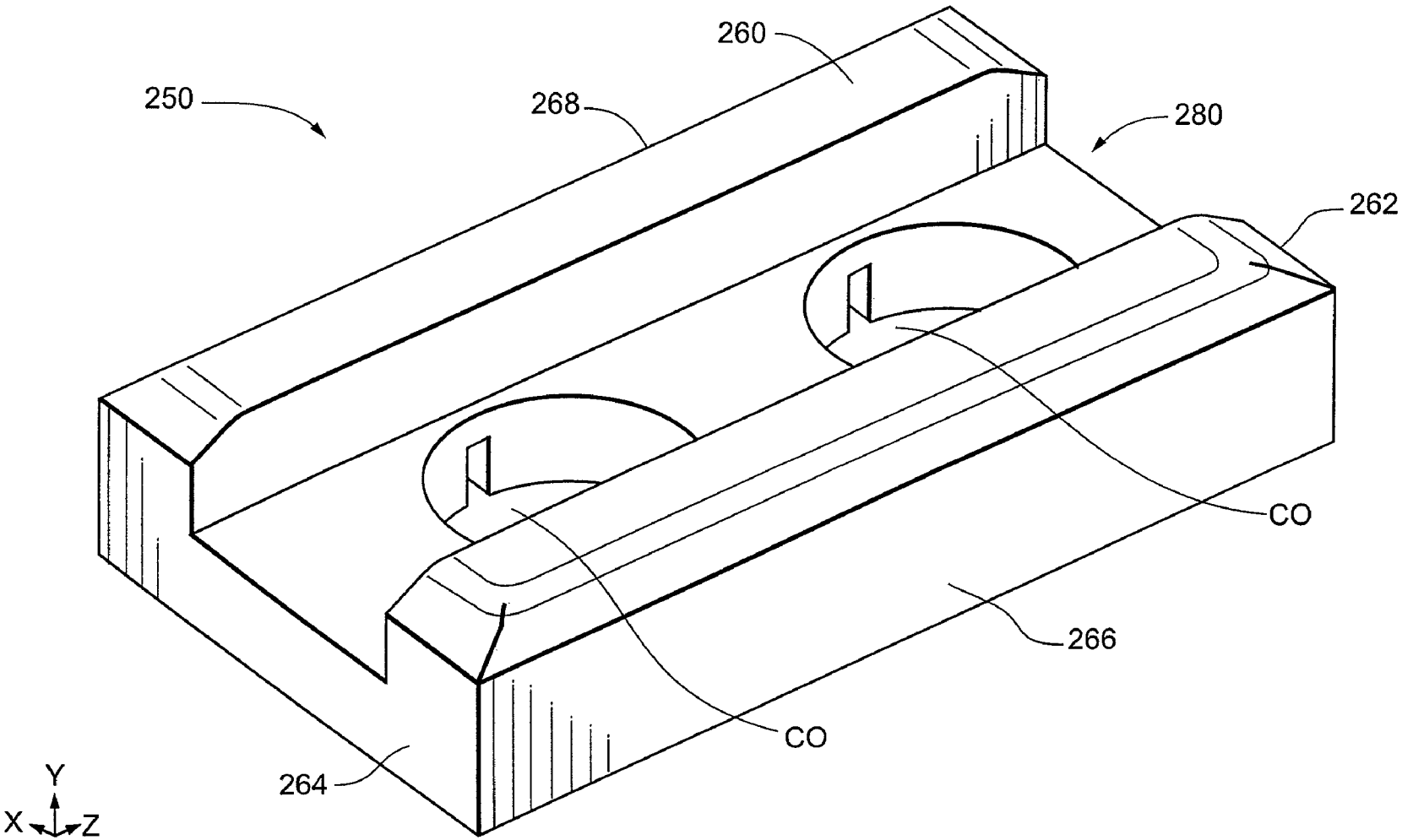
FIG. 14 is a perspective view of a die shoe in accordance with another embodiment of the invention.

In some of the present die shoe embodiments, the die shoe has a die-mounting recess 280 open to at least one generally circular opening CO that passes entirely through the die shoe (e.g., such that the opening CO opens through the bottom of the die shoe). FIG. 11, for example, depicts an embodiment where the die shoe has a die-mounting recess 280 extending between two lateral sides of the die shoe, and a generally circular opening CO intersects the recess 280 and is open entirely through the bottom wall of the die shoe. FIGS. 12 and 14 show embodiments where the die-mounting recess 280 extends between the inside and outside ends of the die shoe, and two spaced-apart generally circular openings CO intersect the recess 280 and are open entirely through the bottom wall of the die shoe. Many other variations of this nature will be apparent to skilled artisans given the present disclosure as a guide.

Some embodiments of the invention provide methods of fabricating a workpiece. Such methods may utilize any embodiment of the multi-drive tool 100 discussed herein. In some embodiments, the method includes actuating a ram 104 of the press 10 to initiate a ram stroke that accelerates the multi-drive tool 100 such that the drive members 120 (or components thereof) are actuated simultaneously, e.g., so as to cause one or more tip sections of the tool to bear forcibly against, and thereby deform, a workpiece. In certain embodiments, force is delivered from the ram 104 to a head 170 of the multi-drive tool 100, thereby causing the simultaneous actuation of the drive members 120. In some cases, the drive members 120 (or components thereof) comprise respective shafts that move axially in response to the ram stroke. Optionally, the bridge member 130 is retained above the upper table 30, and/or the tip section is retained below the upper table 30, throughout the ram stroke. In embodiments involving a multi-drive tool 100 with a plurality of discrete tip sections located at respective leading end regions of the drive members 120, simultaneous actuation of the drive members 120 results in the multiple tip sections creating a plurality of spaced-apart deformations in the workpiece. Thus, the present methods are useful for allowing a single stroke of a ram 104 to simultaneously actuate multiple drive members 120 received within respective mount openings 90 of multiple stations 80 of a press 10.

While preferred embodiments of the present invention have been described, it should be understood that various changes, adaptations and modifications can be made therein without departing from the spirit of the invention and the scope of the appended claims.

What is claimed is:

1. A press and a multi-drive tool in combination, the press having an upper table with multiple spaced-apart stations each including a mount opening passing vertically through the table, the press having a ram, the ram and the table being adapted for relative movement such that the ram can be selectively aligned with different stations of the table, the multi-drive tool having a tip section adapted to bear forcibly and thereby deform a workpiece, the multi-drive tool including a plurality of drive members mounted in respective mount openings of plural spaced-apart stations of the table, the drive members comprising respective elongated shafts that move axially within the respective mount openings in response to a single ram stroke of the press, the multi-drive tool having a bridge member rigidly connected to at least one of the drive members and configured such that in response to the ram stroke of the press the drive members are actuated simultaneously, the bridge member comprising an elongated body having a major dimension extending between opposing first and second ends, the drive members being at least generally parallel to each other, and the bridge member being at least generally perpendicular to the drive members.

2. The combination of claim 1 wherein the drive members extend vertically through said respective mount openings, and the bridge member extends horizontally between, and connects, the vertical drive members.

3. The combination of claim 2 wherein the bridge member is retained above the upper table, and the drive members extend downwardly from the bridge member toward a lower table of the press.

4. The combination of claim 1 wherein the tip section is connected removably to respective leading end regions of the drive members, the tip section being retained below the upper table.

5. The combination of claim 1 wherein said simultaneous actuation involves the drive members moving simultaneously in a direction toward the workpiece.

6. The combination of claim 1 wherein said simultaneous actuation involves at least one moveable portion of each drive member moving in a direction toward the workpiece.

7. The combination of claim 1 wherein the tip section connects respective leading end regions of the drive members and is at least generally perpendicular to the drive members, and the bridge member connects respective trailing end regions of the drive members.

8. The combination of claim 1 wherein the tip section is adapted to create in the workpiece a deformation having a major dimension greater than 4½ inches.

9. The combination of claim 1 wherein the press is a turret press, said upper table is an upper turret table, the turret press includes a lower turret table, and the upper and lower turret tables are rotatable about a vertical axis.

10. The combination of claim 1 wherein each of the drive members has a generally cylindrical configuration.

11. The combination of claim 10 wherein the bridge member comprises a rigid plate.

12. The combination of claim 1 wherein the multi-drive tool includes a plurality of discrete tip sections located at respective leading end regions of said drive members, these tip sections being adapted to simultaneously create a plurality of spaced-apart deformations in a workpiece.

13. A method of fabricating a workpiece, the method involving a multi-drive tool mounted operatively on a press, the press having an upper table with multiple spaced-apart stations each including a mount opening passing vertically through the table, the press having a ram, the ram and the table being adapted for relative movement such that the ram can be selectively aligned with different stations of the table, the multi-drive tool including a plurality of drive members mounted in respective mount openings of plural spaced-apart stations of the table, the drive members comprising respective elongated shafts that move axially within the respective mount openings in response to a single ram stroke of the press, the multi-drive tool having a bridge member rigidly connected to at least one of the drive members, the multi-drive tool including a tip section located at a leading end region of at least one of the drive members, the method comprising operating the ram to initiate the ram stroke, the bridge member being configured such that the ram stroke simultaneously actuates the drive members and causes the tip section of the multi-drive tool to bear forcibly against and deform the workpiece, the bridge member comprising an elongated body having a major dimension extending between opposing first and second ends, the multiple drive members being at least generally parallel to each other, and the bridge member being at least generally perpendicular to the drive members.

14. The method of claim 13 wherein throughout the ram stroke the bridge member is retained above the upper table.

15. The method of claim 13 wherein the tip section is connected removably to respective leading end regions of the drive members, and wherein throughout the ram stroke the tip section is retained below the upper table.

16. The method of claim 13 wherein the drive members extend vertically through said respective mount openings, and the bridge member extends horizontally between, and connects, the vertical drive members.

17. The method of claim 13 wherein the ram stroke causes the drive members to simultaneously move downwardly relative to the upper table.

18. The method of claim 13 wherein the ram stroke causes at least one moveable portion of each drive member to move downwardly relative to the upper table.

19. The method of claim 13 wherein the multi-drive tool has a head, and wherein during the ram stroke force is delivered from the ram to the head of the multi-drive tool, thereby causing said simultaneous actuation of the drive members.

20. The method of claim 13 wherein the tip section creates in the workpiece a deformation having a major dimension greater than 4½ inches.

21. The method of claim 13 wherein the tip section creates in the workpiece a deformation having a major dimension greater than 6 inches.

22. The method of claim 13 wherein the tip section creates in the workpiece a deformation having a major dimension greater than 8 inches.

23. The method of claim 13 wherein the multi-drive tool includes a plurality of discrete tip sections located at respective leading end regions of said drive members, wherein said simultaneous actuation of the drive members results in the multiple tip sections creating a plurality of spaced-apart deformations in the workpiece.

24. A multi-drive tool for use on a press having an upper table with multiple spaced-apart stations each including a mount opening passing vertically through the table, the multi-drive tool having a tip section adapted to bear forcibly against and thereby deform a workpiece, the multi-drive tool including two drive members configured to be operatively mounted simultaneously in respective mount openings of two spaced-apart stations of the upper table, the drive members comprising respective elongated shafts that move axially within the respective mount openings in response to a single ram stroke of the press, the multi-drive tool having a bridge member rigidly connected to at least one of drive members and being configured such that the single ram stroke of the press simultaneously actuates said drive members, the bridge member comprising an elongated body having a major dimension extending between opposing first and second ends, the two drive members being at least generally parallel to each other, and the bridge member being at least generally perpendicular to the drive members.

25. The multi-drive tool of claim 24 wherein at least one of the drive members is configured to be a floating drive member, such that when the multi-drive tool is operatively assembled the floating drive member has at least a limited range of lateral freedom of motion relative to the bridge member.

26. The multi-drive tool of claim 25 wherein the floating drive member has a generally cylindrical configuration, and said freedom of motion allows radial motion of at least 0.002 inch relative to the bridge member.

27. The multi-drive tool of claim 25 wherein a plurality of the drive members are configured to be floating drive members, such that when the multi-drive tool is operatively assembled the floating drive members each have at least a limited range of lateral freedom of motion relative to the bridge member.

28. The multi-drive tool of claim 27 wherein the multi-drive tool includes a center drive member rigidly connected to the bridge member, and wherein said center drive member is located between two floating drive members.

29. The multi-drive tool of claim 24 wherein the bridge member comprises a rigid elongated body that connects said drive members, wherein a first of said drive members is attached to the rigid elongated body adjacent said first end, and a second of said drive members is attached to the rigid elongated body adjacent said second end.

30. The multi-drive tool of claim 24 wherein the bridge member connects respective trailing end regions of said drive members.

31. The multi-drive tool of claim 24 wherein the bridge member is configured to be retained above the upper table when the multi-drive tool is mounted operatively on the press.

32. The multi-drive tool of claim 24 wherein each of said drive members has a generally cylindrical configuration.

33. The multi-drive tool of claim 32 wherein the bridge member comprises a rigid plate.

34. The multi-drive tool of claim 24 wherein said simultaneous actuation involves the drive members moving simultaneously in a direction toward the workpiece.

35. The multi-drive tool of claim 24 wherein said simultaneous actuation involves at least one moveable portion of each drive member moving in a direction toward the workpiece.

36. The multi-drive tool of claim 24 wherein the multi-drive tool has a head adapted to receive force from a ram of the press, such that during the ram stroke, force is delivered from the ram to the head of the multi-drive tool.

37. The multi-drive tool of claim 36 wherein the multi-drive tool has a height-adjustment mechanism, and a height of the multi-drive tool changes in response to adjusting the height-adjustment mechanism.

38. The multi-drive tool of claim 37 wherein the height-adjustment mechanism comprises the head of the multi-drive tool.

39. The multi-drive tool of claim 38 wherein said adjusting of the height-adjustment mechanism involves rotating the head relative to the bridge member.

40. The multi-drive tool of claim 24 wherein the tip section is located at a leading end region of at least one of the drive members.

41. The multi-drive tool of claim 40 wherein the tip section is removably connected to respective leading end regions of said drive members.

42. The multi-drive tool of claim 41 wherein the tip section is at least generally perpendicular to said drive members.

43. The multi-drive tool of claim 41 wherein the tip section is configured to be retained below the upper table when the multi-drive tool is mounted operatively on the press.

44. The multi-drive tool of claim 40 wherein the tip section connects respective leading end regions of said drive members and is at least generally perpendicular to said drive members, and the bridge member connects respective trailing end regions of said drive members.

45. The multi-drive tool of claim 24 wherein the tip section is adapted to create in the workpiece a deformation having a major dimension greater than 4½ inches.

46. The multi-drive tool of claim 24 wherein the tip section is adapted to create in the workpiece a deformation having a major dimension greater than 6 inches.

47. The multi-drive tool of claim 24 wherein the tip section is adapted to create in the workpiece a deformation having a major dimension greater than 8 inches.

48. The multi-drive tool of claim 40 wherein the multi-drive tool includes two discrete tip sections located at respective leading end regions of said two drive members, the two tip sections being adapted to simultaneously create two spaced-apart deformations in the workpiece.

49. The multi-drive tool of claim 24 wherein the tip section is connected to leading end regions of all the drive members.

50. A multi-drive tool for use on a press having an upper table with multiple spaced-apart stations each including a mount opening passing vertically through the table, the multi-drive tool having a tip section adapted to bear forcibly against and thereby deform a workpiece, the multi-drive tool including two drive members configured to be operatively mounted simultaneously in respective mount openings of two spaced-apart stations of the table, the drive members comprising respective elongated shafts that move axially within the respective mount openings in response to a single ram stroke of the press, the two drive members being at least generally parallel to each other, the multi-drive tool having a bridge member rigidly connected to at least one of the drive members and being configured such that the single ram stroke of the press simultaneously actuates said drive members, at least one of the drive members being configured to be a floating drive member such that when the multi-drive tool is operatively assembled the floating drive member has at least a limited range of lateral freedom of motion relative to the bridge member, the bridge member comprising an elongated body having a major dimension extending between opposing first and second ends, the bridge member being at least generally perpendicular to the two drive members.

51. The multi-drive tool of claim 50 wherein the multi-drive tool has at least one height-adjustment mechanism, such that a height of at least one drive member of the tool changes in response to adjusting the height-adjustment mechanism.

52. The multi-drive tool of claim 50 wherein the tip section is connected to leading end regions of all the drive members.

* * * * *